US007008319B2

(12) United States Patent
Montgomery et al.

(10) Patent No.: US 7,008,319 B2
(45) Date of Patent: Mar. 7, 2006

(54) MULTI-GAME MACHINE AND METHOD FOR SIMULTANEOUS PLAY

(75) Inventors: David B. Montgomery, deceased, late of Reno, NV (US); by Diane S. Montgomery, legal representative, Reno, NV (US); Tyler T. Parham, 1205 Haskell St., Reno, NV (US) 89509-2842

(73) Assignee: Tyler T. Parham, Reno, NV (US)

( * ) Notice: Subject to any disclaimer, the term of this patent is extended or adjusted under 35 U.S.C. 154(b) by 0 days.

(21) Appl. No.: 09/770,998

(22) Filed: Jan. 25, 2001

(65) Prior Publication Data

US 2002/0002073 A1 Jan. 3, 2002

Related U.S. Application Data

(60) Provisional application No. 60/178,348, filed on Jan. 25, 2000.

(51) Int. Cl.
*A63F 9/24* (2006.01)

(52) U.S. Cl. ..... 463/21; 463/25; 463/16

(58) Field of Classification Search ..... 463/25–26, 463/40, 42, 16–22, 12–13; 273/142 E, 142 R, 273/292–293, 236–237; 700/91–93
See application file for complete search history.

(56) References Cited

U.S. PATENT DOCUMENTS 4,856,787 A 8/1989 Itkis
5,242,163 A 9/1993 Fulton
5,377,973 A * 1/1995 Jones et al. ..... 463/12
5,377,993 A 1/1995 Josephs
5,393,057 A 2/1995 Marnell, II
5,411,257 A 5/1995 Fulton
5,531,440 A 7/1996 Dabrowski et al.
5,531,441 A 7/1996 Dabrowski et al.
5,564,700 A * 10/1996 Celona ..... 463/27
5,636,843 A 6/1997 Roberts
5,762,552 A * 6/1998 Vuong et al. ..... 463/25
5,770,533 A * 6/1998 Franchi ..... 463/42
5,791,989 A 8/1998 Slinkman
5,851,147 A * 12/1998 Stupak et al. ..... 463/13
5,868,618 A 2/1999 Netley et al.
5,879,233 A 3/1999 Stupero
5,976,016 A * 11/1999 Moody et al. ..... 463/20
6,068,552 A * 5/2000 Walker et al. ..... 463/21
6,077,162 A 6/2000 Weiss
6,098,985 A 8/2000 Moody
6,135,883 A 10/2000 Hachquet
6,206,782 B1 3/2001 Walker et al.
6,312,332 B1 * 11/2001 Walker et al. ..... 463/23
2002/0077167 A1 6/2002 Merari
2002/0132657 A1 * 9/2002 Matthiesen et al. ..... 463/13

* cited by examiner

*Primary Examiner*—Mark Sager
(74) *Attorney, Agent, or Firm*—Brian N. Young; Townsend and Townsend and Crew, LLP

(57) ABSTRACT

An electronic gaming device having a plurality of games available for selection by a user allows selection of multiple games for concurrent play. One or more of the multiple games selected by the user in turn are utilized to create composite pay tables. These selection-dependant pay tables in turn provide the basis for additional betting opportunities for the user. The networking of multiple electronic gaming devices having the concurrent play feature provides multiple users with the betting opportunities embodied in these composite pay tables.

68 Claims, 37 Drawing Sheets

Any action can be initiated by touching the screen.

| | 1st coin | 2nd coin | 3rd coin | 4th coin | 5th coin |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

FIG. 2
Any action can be initiated by touching the screen.
| | 1st coin | 2nd coin | 3rd coin | 4th coin | 5th coin |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |
BET 1 TO 5 CREDITS ON ALL GAMES
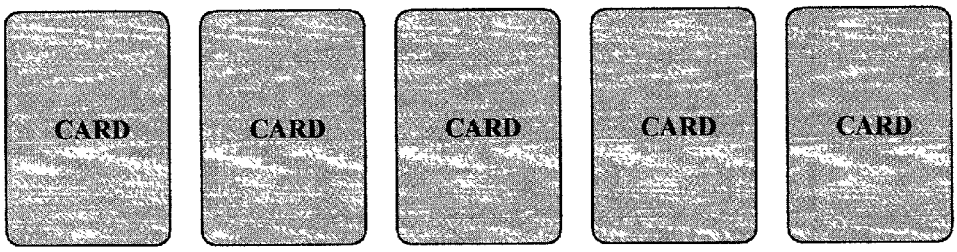
BET 5 CREDITS 25 CENT JACKS OR BETTER GAME ONE
60
CREDIT $8.75
TOUCH DEAL TO PLAY
50
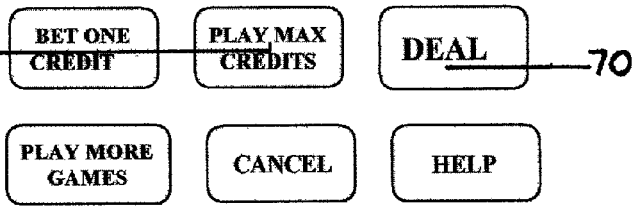
70

FIG. 3
Any action can be initiated by touching the screen.
| | 1st coin | 2nd coin | 3rd coin | 4th coin | 5th coin |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |
TOUCH CARDS TO HOLD OR CANCEL
ONE PAIR
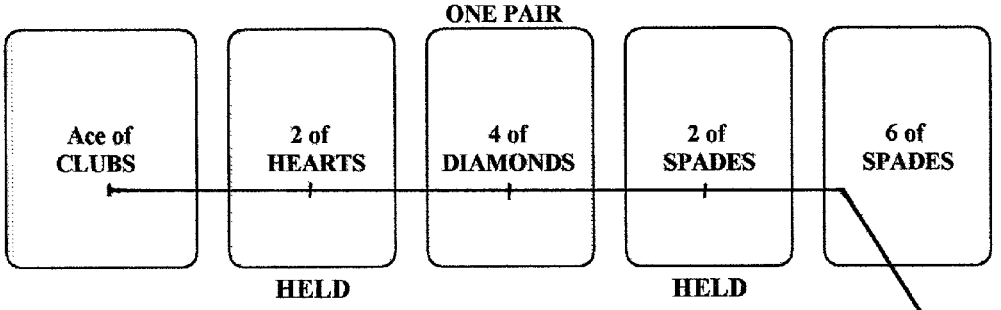
BET 5 CREDITS 25 CENT JACKS OR BETTER GAME ONE 80
CREDIT $8.75
TOUCH DRAW TO PLAY
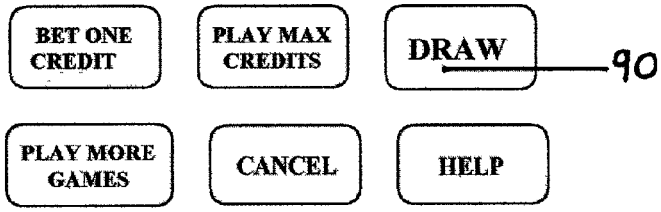

FIG. 4

Any action can be initiated by touching the screen.

| | 1st coin | 2nd coin | 3rd coin | 4th coin | 5th coin |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

BET 1 TO 5 CREDITS ON ALL GAMES

110

THREE OF A KIND WINNER PAID 15 CREDITS 2 of CLUBS | 2 of HEARTS | Ace of DIAMONDS | 2 of SPADES | Queen of SPADES

HELD HELD

BET 5 CREDITS 25 CENT JACKS OR BETTER GAME ONE

CREDIT $11.25 120 80

TOUCH DEAL TO PLAY

125 PLAY MORE GAMES | BET ONE CREDIT | PLAY MAX CREDITS | DEAL

CANCEL | CASH OUT | HELP

FIG. 5
Any action can be initiated by touching the screen.
| | 1st coin | 2nd coin | 3rd coin | 4th coin | 5th coin |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |
BET 1 TO 5 CREDITS
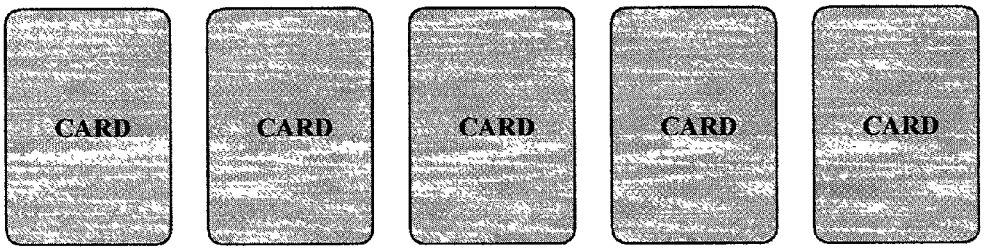
25 CENT JACKS OR BETTER GAME ONE
CREDIT $10.00—20
TOUCH TO PLAY
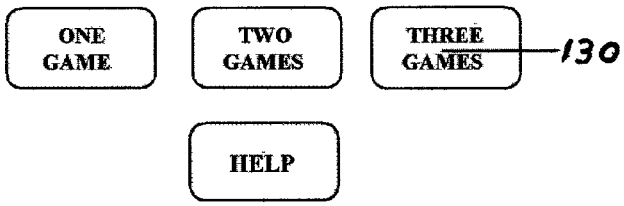

FIG. 10

PAY TABLES

| CREDITS WAGERED | 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

25 CENT JACKS OR BETTER GAME THREE

| CREDITS WAGERED | 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

25 CENT JACKS OR BETTER GAME TWO

| CREDITS WAGERED | 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

25 CENT JACKS OR BETTER GAME ONE

RETURN TO GAME

FIG. 13

Any action can be initiated by touching the screen.

PLAYER IS ELIGIBLE FOR BONUS PAYS WHILE PLAYING MAX COINS ON TWO OR MORE GAMES. 210

| | 1st coin | 2nd coin | 3rd coin | 4th coin | 5th coin |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

BET 1 TO 5 CREDITS

CARD CARD CARD CARD CARD

25 CENT JACKS OR BETTER "BONUS PAYS" GAME ONE

CREDIT $10.00 20

TOUCH TO PLAY

ONE GAME | TWO GAMES | THREE GAMES 220

230 SEE BONUS PAYS | SEE PAYS | HELP

FIG. 14

PLAYER ELIGIBLE FOR BONES PAYS WHILE PLAYING
MAX COINS ON TWO OR MORE GAMES.

BONUS PAYS PAY TABLES

| TWO OUT OF TWO GAMES | CREDITS |
|---|---|
| ROYAL FLUSHES | 2000 |
| STRAIGHT FLUSHES | 125 |
| FOUR OF A KINDS | 60 |
| FULL HOUSES | 25 |
| FLUSHES | 20 |
| STRAIGHTS | 15 |
| THREE OF A KINDS | 10 |
| PAIRS | 5 |
| JACKS OR BETTER | 5 |
| **TWO OUT OF THREE GAMES** | |
| ROYAL FLUSHES | 1000 |
| STRAIGHT FLUSHES | 75 |
| FOUR OF A KINDS | 30 |
| FULL HOUSES | 25 |
| FLUSHES | 20 |
| STRAIGHTS | 15 |
| THREE OF A KINDS | 10 |
| TWO PAIRS | 5 |
| JACKS OR BETTER | 5 |
| **THREE OUT OF THREE GAMES** | |
| ROYAL FLUSHES | 3000 |
| THREE STRAIGHT FLUSHES | 200 |
| FOUR OF A KINDS | 40 |
| FULL HOUSES | 35 |
| FLUSHES | 30 |
| STRAIGHTS | 25 |
| THREE OF A KINDS | 20 |
| TWO PAIRS | 15 |
| JACKS OR BETTER | 10 |

RETURN TO GAME

FIG. 20

DRAW POKER HAND FREQUENCIES

| | |
|---|---|
| **ONE OUT OF ONE GAME** | |
| ROYAL FLUSH | 40,000.00 |
| STRAIGHT FLUSH | 13,333.33 |
| FOUR OF A KIND | 434.78 |
| FULL HOUSE | 90.09 |
| FLUSH | 90.91 |
| STRAIGHT | 87.72 |
| THREE OF A KIND | 13.77 |
| TWO PAIR | 7.94 |
| JACKS OR BETTER | 4.67 |
| ALL OTHER HANDS | 1.81 |
| **TWO OUT OF TWO GAMES** | |
| ROYAL FLUSH | 1,600,000,000.00 |
| STRAIGHT FLUSH | 177,777,777.78 |
| FOUR OF A KIND | 189,035.92 |
| FULL HOUSE | 8,116.22 |
| FLUSH | 8,264.46 |
| STRAIGHT | 7,694.68 |
| THREE OF A KIND | 189.73 |
| TWO PAIR | 62.99 |
| JACKS OR BETTER | 21.84 |
| ALL OTHER HANDS | 3.29 |
| **TWO OUT OF THREE GAMES** | |
| ROYAL FLUSH | 1,066,666,666.70 |
| STRAIGHT FLUSH | 118,518,518.52 |
| FOUR OF A KIND | 126,023.95 |
| FULL HOUSE | 5,410.81 |
| FLUSH | 5,509.64 |
| STRAIGHT | 5,129.79 |
| THREE OF A KIND | 126.49 |
| TWO PAIR | 41.99 |
| JACKS OR BETTER | 14.56 |
| ALL OTHER HANDS | 2.19 |
| **THREE OUT OF THREE GAMES** | |
| ROYAL FLUSH | 64,000,000,000,000.00 |
| STRAIGHT FLUSH | 2,370,369,777,807.41 |
| FOUR OF A KIND | 82,189,037. 30 |
| FULL HOUSE | 731,190.26 |
| FLUSH | 751,322.06 |
| STRAIGHT | 674,977.33 |
| THREE OF A KIND | 2,612.58 |
| TWO PAIR | 500.14 |
| JACKS OR BETTER | 102.99 |
| ALL OTHER HANDS | 5.95 |

FIG. 21

Any action can be initiated by touching the screen.

PLAY 5 CREDITS ON BIG MONEY WHILE PLAYING TWO OR MORE GAMES FOR A CHANCE TO WIN REALLY BIG MONEY

| | 1st credit | 2nd credit | 3rd credit | 4th credit | 5th credit |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

BET 1 TO 5 CREDITS

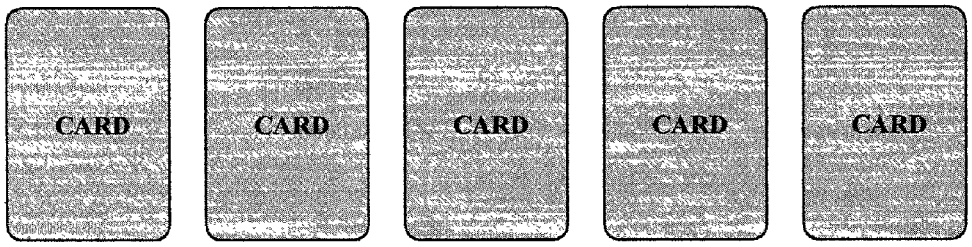

25 CENT JACKS OR BETTER GAME ONE

CREDIT $10.00 — 20

TOUCH TO PLAY

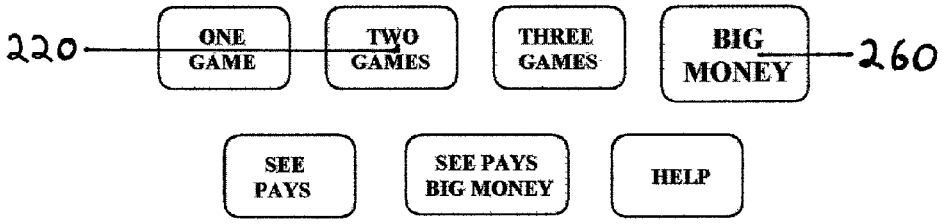

FIG. 22

Any action can be initiated by touching the screen.

PLAY MAX COINS ON BIG MONEY WHILE PLAYING TWO OR MORE GAMES FOR A CHANCE TO WIN REALLY BIG MONEY

BET 5 CREDITS

25 CENT $$ BIG MONEY $$ GAME

BET 1 TO 5 CREDITS ON GAMES ONE & TWO

CARD CARD CARD CARD CARD

25 CENT JACKS OR BETTER GAME TWO

CARD CARD CARD CARD CARD

BET 5 CREDITS 25 CENT JACKS OR BETTER GAME ONE

CREDIT $8.75

TOUCH TO PLACE BET GAME ONE

50 BET ONE CREDIT | BET MAX CREDITS | PLACE BET GAME ONE | BIG MONEY 130

SEE PAYS | SEE PAYS BIG MONEY | CANCEL | HELP

FIG. 23

Any action can be initiated by touching the screen.

PLAY 5 CREDITS ON BIG MONEY WHILE PLAYING TWO OR MORE GAMES FOR A CHANCE TO WIN REALLY BIG MONEY

BET 5 CREDITS

25 CENT $$ BIG MONEY $$ GAME

BET 1 TO 5 CREDITS ON GAMES ONE & TWO

CARD CARD CARD CARD CARD

BET 5 CREDITS 25 CENT JACKS OR BETTER GAME TWO

CARD CARD CARD CARD CARD

BET 5 CREDITS 25 CENT JACKS OR BETTER GAME ONE

CREDIT $7.50

TOUCH TO PLACE BET GAME TWO

50 BET ONE CREDIT | BET MAX CREDITS | PLACE BET GAME TWO | BIG MONEY 145

SEE PAYS | SEE PAYS BIG MONEY | CANCEL | HELP

FIG. 27

PLAY 5 CREDITS ON $$ BIG MONEY $$ WHILE PLAYING TWO OR MORE GAMES FOR A CHANCE TO WIN REALLY BIG MONEY.

$$ BIG MONEY PAY TABLES $$

| | CREDITS |
|---|---|
| TWO OUT OF TWO GAMES | |
| ROYAL FLUSHES | 160,000 |
| STRAIGHT FLUSHES | 6,250 |
| FOUR OF A KINDS | 1,560 |
| FULL HOUSES | 200 |
| FLUSHES | 90 |
| STRAIGHTS | 40 |
| THREE OF A KINDS | 30 |
| PAIRS | 20 |
| JACKS OR BETTER | 15 |
| TWO OUT OF THREE GAMES | |
| ROYAL FLUSHES | 53,000 |
| STRAIGHT FLUSHES | 2,000 |
| FOUR OF A KINDS | 520 |
| FULL HOUSES | 60 |
| FLUSHES | 30 |
| STRAIGHTS | 15 |
| THREE OF A KINDS | 10 |
| TWO PAIRS | 6 |
| JACKS OR BETTER | 5 |
| THREE OUT OF THREE GAMES | |
| ROYAL FLUSHES | 6,400,000 |
| THREE STRAIGHT FLUSHES | 156,250 |
| FOUR OF A KINDS | 19,530 |
| FULL HOUSES | 9,100 |
| FLUSHES | 2,700 |
| STRAIGHTS | 800 |
| THREE OF A KINDS | 340 |
| TWO PAIRS | 100 |
| JACKS OR BETTER | 50 |

RETURN TO GAME

FIG. 30

Any action can be initiated by touching the screen.

PLAY 5 CREDITS ON BIG MONEY WHILE PLAYING TWO OR MORE GAMES FOR A CHANCE TO WIN REALLY BIG MONEY

BET 5 CREDITS

BET 5 CREDITS 25 CENT $$ BIG MONEY $$ GAME

BET 1 TO 5 CREDITS

CARD CARD CARD CARD CARD

BET 5 CREDITS $1.00 JACKS OR BETTER GAME TWO

BET 1 TO 40 CREDITS

CARD CARD CARD CARD CARD

BET 20 CREDITS 5 CENT JACKS OR BETTER GAME ONE

CREDIT $4.00

TOUCH DEAL TO PLAY

CHANGE GAMES | CHANGE Denominations | CHANGE BETS | DEAL

SEE PAYS | SEE PAYS BIG MONEY | CANCEL | HELP

FIG. 31
MACHINE 500
1
Any action can be initiated by touching the screen.
| | 1st credit | 2nd credit | 3rd credit | 4th credit | 5th credit |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |
BET 1 TO 5 CREDITS
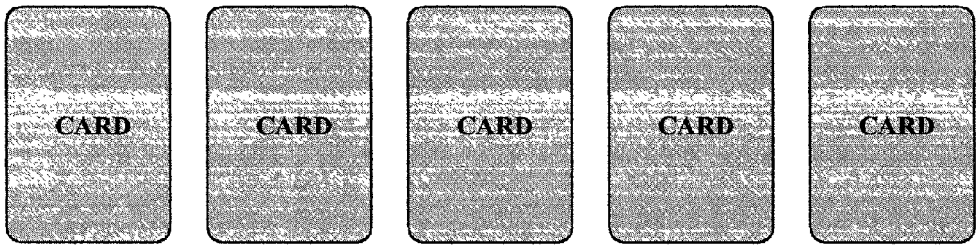
25 CENT JACKS OR BETTER GAME ONE
CREDIT $10.00
TOUCH TO PLAY
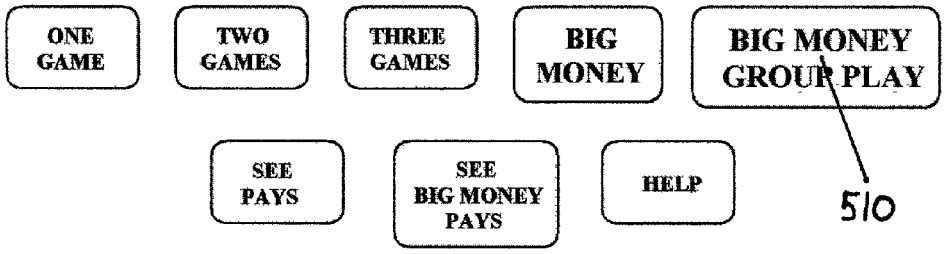

FIG. 33

MACHINE
1

Any action can be initiated by touching the screen.

$BIG MONEY$ GROUP PLAY "BET TWO CREDIT" 540

550 machines 1&2 participating in $BIG MONEY$ GROUP PLAY

| | 1st coin | 2nd coin | 3rd coin | 4th coin | 5th coin |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

BET 1 TO 5 CREDITS

CARD CARD CARD CARD CARD

25 CENT JACKS OR BETTER GAME ONE

CREDIT $10.00

TOUCH TO PLAY

BET ONE CREDIT | BET MAX CREDITS | CHANGE BETS | DRAW

SEE PAYS | SEE BIG MONEY PAYS | CANCEL | HELP

FIG. 34

MACHINE 2 — 560

Any action can be initiated by touching the screen.

| | 1st credit | 2nd credit | 3rd credit | 4th credit | 5th credit |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

BET 1 TO 5 CREDITS

CARD CARD CARD CARD CARD

25 CENT JACKS OR BETTER GAME ONE

CREDIT $10.00

TOUCH TO PLAY

ONE GAME | TWO GAMES | THREE GAMES | BIG MONEY | BIG MONEY GROUP PLAY — 510

SEE PAYS | SEE BIG MONEY PAYS | HELP

FIG. 36
MACHINE
2
Any action can be initiated by touching the screen.
$BIG MONEY$ GROUP PLAY "BET TWO CREDIT" 540
610 machines 2&1 participating in $BIG MONEY$ GROUP PLAY
| | 1st coin | 2nd coin | 3rd coin | 4th coin | 5th coin |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |
BET 1 TO 5 CREDITS
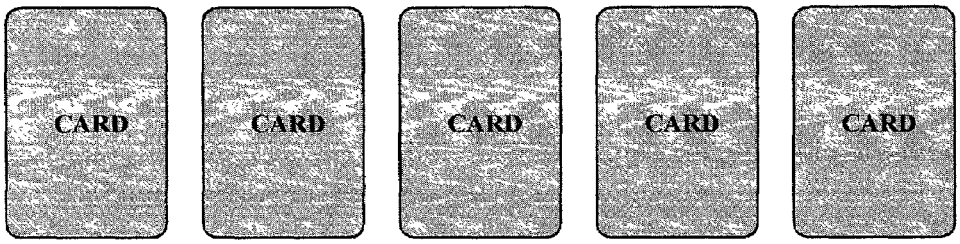
25 CENT JACKS OR BETTER GAME ONE
CREDIT $10.00
TOUCH TO PLAY
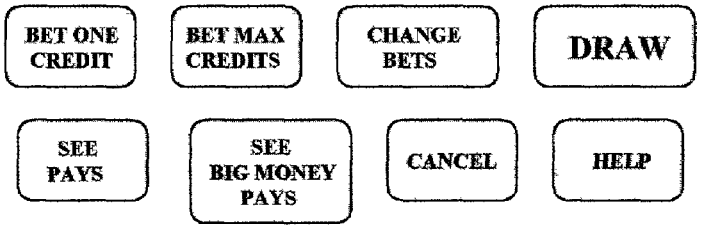

MULTI-GAME MACHINE AND METHOD FOR SIMULTANEOUS PLAY

CROSS-REFERENCE TO RELATED APPLICATION

This application claims the benefit of U.S. Provisional Application, Ser. No. 60/178,348, filed Jan. 25, 2000.

BACKGROUND OF THE INVENTION

1. Field of the Invention

The present invention relates to electronic gaming apparatus and methods and, more particularly, to such apparatus and methods for playing games such as poker, slot machines, keno, and secondary feature games. More specifically, the present invention relates to electronic gaming machines and methods that provide one or more players with the option to play individual games independently or simultaneously or, where there are multiple machines, to play such games independently or simultaneously and jointly with one or more players seated at separate machines.

2. Description of the Prior Art

Electronic video gaming machines, for example, the GAME KING® by IGT® and the GAME MAKER® of Bally Gaming Systems®, have become a significant part of the gaming industry. With the help of advancements in microcomputer technology manufactures have expanded game features to allow players the ability to play a variety of games e.g., Slot, Poker, Keno, etc., to be displayed in a single game format (one game per machine) or a multi-game format (a variety of games per machine). Depending upon the machine, a player has the option of playing an independent game from a single game format or the ability to play an independent game from a multi game format. These advanced features are used to increase player appeal and to increase the volume of play ("coin-in"). The proliferation of legalized gaming has saturated the desirable locations for gaming establishments. Manufacturers of electronic video machines have been creating new games, bonuses, and a variety of progressive systems having giant jackpots—all to attract players and raise the volume of "coin in" in efforts, which helps casinos maximize profits over their limited gaming floor space. Casinos also compete for "player time" with other casinos because of the normal close proximity of the establishments.

Today game manufacturers are using a number of strategies to sell new machines, create player appeal, promote play and most importantly, increase the volume of coin in. A few of these strategies are listed below:

1. Using current technology, gaming companies are improving old games and creating new games with sophisticated hardware, software, and video graphics;
2. Using U.S. Pat. No. 4,448,419, permits an electronic gaming machine to have higher odds. Manufacturers & Casinos are using wide area progressive systems that can link together electronic gaming machines from casino to casino, forming one progressive jackpot. The more machine connected to a single progressive the faster it will grow. Wide area progressive systems create fast, growing progressives that are seeded with high jackpot amounts;
3. Using entertaining themes, gaming companies are using the familiarity of TV shows, board games and personalities to create entertaining new games; and 4. Using second event games, as in U.S. Pat. No. 5,823,874, gaming companies are creating special payouts and bonuses.

All of the strategies listed above have proven successful in the gaming market. However, even with the use of current technology and ingenious gaming concepts, up until the present day the player has only been able to play one independent game at a time. By using the proper programming, the method of the present invention can be used with all the strategies listed above.

Presently, the only way for a player to play multiple games is to concurrently play on adjoining machines. There has also been a limit to the justified odds and pay tables constructed from the existing games.

SUMMARY OF THE INVENTION

There is a demand in the gaming market for a new method of game play on electronic video machines. A method of game play that would provide the player with: new games and/or bonuses with lower odds and larger jackpots, that would not change the percentage of payback on existing games; a method of game play that would allow for a higher volume of "coin-in" per machine; and a method of game play that would promote groups of game players to participate in the same establishment.

By programming electronic video machines to permit players to play independent games or to play such independent games simultaneously and/or in conjunction with other independent games. Pay tables with lower odds and larger jackpots could be created for such new games and/or bonuses. This strategy would also allow for a higher volume of "coin in" by allowing the player(s) to place multiple wagers on multiple games using a independent electronic video machine or networked independent electronic video machine. This method would create a new dimension of game play for players and the gaming industry.

The method of the present invention can be used on any electronic gaming apparatus and more particularly to that class of gaming machines known as "electronic video machines" that are suitably programmed. Furthermore, where such a machine is so programmed, the method of the present invention can be used with virtually all of the existing games and game styles (Slot, Poker, Keno, etc.), as are available in the gaming market today.

The growth in new casinos is slowing, and new machine replacement is expected to drive the bulk of future business in the gaming market. This in turn provides a great opportunity to upgrade older machines and create a new generation of gaming machines with a method of game play that will enable casinos to have a higher volume of "coin in".

It is an object of the present invention to be used in any old or new gaming apparatus that is suitably programmed in the gaming market.

It is a still further object of the present invention to provide a method of game play on a gaming machine that gives the player a more entertaining gaming experience, and one that is easy to understand.

The method of the present invention is also beneficial to the casinos and the customers. By enabling the player to play independent games simultaneously and/or in conjunction with other games, the player can play more than one of his or her favorite games at the same time without having to move from one machine to the next. This can be accomplished in an auto-play style and/or the player can play all the independent games on the screen at the same time.

With casinos and other gaming establishments having limited floor space, even when all of the gaming machines are being played, there remains a limit to the amount of "coin in" possible using those machines and their present manner of play. In contrast, utilization of the present inventive method enables an increase in the "coin in", generating more revenue for the casino and giving the player a new entertaining gaming experience.

It is a further object of the present invention to provide a method of game play on an electronic gaming machine that allows for a higher volume of "coin in", while also permitting the player to play the same games to which they have become accustomed.

The method of the present invention permits a player to wager on and play independent games (for example, those having different odds and pay tables) independently, simultaneously, and/or in conjunction with the same machine game from another electronic gaming machine over a game machine network.

Accordingly, the method of the present invention permits a player to choose the combination of independent games, i.e., those having different odds and pay tables, game styles, denominations, and wagers, yet play such games independently, simultaneously, and/or in conjunction with the other same machine games from an electronic gaming machine.

Yet another object of the present invention is to provide the player(s) with new games and additional opportunities to receive winning payouts.

It is a still further object of the present invention to provide a method of game play on an electronic gaming machine that allows for lower odds by creating, based upon a player's selection of games, pay tables for new games and/or bonuses. These newly created or create-able pay tables will in turn provide players the opportunity to play for higher jackpots and bonuses.

The method of the present invention is to permit the player(s) to wager on and play independent games independently, simultaneously, and/or in conjunction with other games from one or more electronic gaming machines. In addition, if the player(s) chooses to play more than one independent game at a time, the present invention allows the player(s) to become eligible for new games and/or bonuses. The independent games e.g. odds and pay tables, and wagers selected by the player then become parameters in pay tables created from the predetermined indicia of the independent games to create new games and/or bonuses.

A method of the present invention permits the player(s) to choose the combination of independent games, for example, the same or different odds and pay tables, game styles, denominations, and wagers, to be played simultaneously and/or in conjunction with other independent games—those of different odds and pay tables, game styles, denominations, and wagers on more than one electronic gaming machine. The independent games and wagers selected by the player(s) then become parameters in pay tables created from the predetermined indicia of the independent games to create new games and/or bonuses. Utilizing this method of game play, the player is allowed to play his or her favorite independent games while playing a new game and/or bonus.

In a still further object of the present invention, through utilization of a networked gaming system, and by identifying groups of gaming machines with numbers, letters, etc. (for example, machine 1,2,3; machine A,B,C; and so forth), on the video screen of the gaming machines, groups of electronic gaming machines can be linked together, permitting player(s) from the selected groups of gaming machines to play with other player(s) on the same group of gaming machines, using the same method of game play as is described above.

By adding a feature on the video screen that identifies the machines in the group, a player on machine one could select to play with a player on machine two, or with any other player(s) that want to participate in a new game and/or bonus that are playing at the time on the identified group of machines. Likewise, a player on machine two could select to play with a player on gaming machine one, or any other players that want to participate in the new game and/or bonus that are playing at the time on the identified group of machines.

In this manner players would be able to play as groups or teams for the same new games and/or bonuses that are described above. The independent games and wagers selected by the player(s) then become parameters in pay tables created from the predetermined indicia of the independent games to create new games and/or bonuses.

The method of game play under the present invention permits new games and/or bonuses to be created with lower odds and higher paybacks for the player(s) that can be used for large jackpots and/or in conjunction with networked gaming systems, progressive and wide-area progressive, and internet gaming systems. The variety of game pay tables that can be used to create new game and/or bonuses for the player is limited only to the programmer and the options programmed into the chosen gaming apparatus.

It is still another important object of the method of the present invention to permit a player(s) to choose the combination of independent progressive and non-progressive games, game styles, denominations, and wagers to be played independently, simultaneously, and/or in conjunction with other independent progressive and non-progressive games, game styles, denominations, wagers on one or more electronic gaming machine at any remote or multiple-remote gaming and non-gaming sites, using any remote or compatible wide-area progressive systems.

The games, and wagers selected by the player then become parameters in pay tables created from the predetermined indicia of the independent progressive and non-progressive games to create new games and bonuses. In this manner, the player is allowed to play his or her favorite independent games while playing for a progressive or wide-area progressive jackpots.

It is still another important object of the method of the present invention to permit the player(s) to choose the combination of independent progressive and non-progressive games, for example, different odds and pay tables, game styles, denominations, and wagers, to be played simultaneously and/or in conjunction with other independent progressive and non-progressive games, i.e., different odds and pay tables, game styles, denominations, and wagers on more that one electronic gaming apparatus. The games and wagers selected by the player then become parameters in pay tables created from the predetermined indicia of the independent progressive and non-progressive games to create new progressive and wide-area progressive games. This is made possible under the present invention by permitting play on one or more independent gaming machine that is simultaneous and/or in conjunction with machine games. It is thus possible to combine the odds of the independent games to create "combination" games having lower odds.

The method of the present invention is made possible by using a multi-tasking platform in an electronic gaming machine that is properly programmed. In order for players from different electronic gaming apparatuses to play together for the same new games and/or bonuses, the electronic gaming machine must be networked on any suitable gaming system that is being used in the market today.

In one embodiment, an electronic gaming apparatus is provided. The electronic gaming device comprises: a plurality of games accessible to a user; a user-actuatable input means in communication with said electronic gaming device to communicate an input signal from said user; and a game controller in communication with said user-actuatable input means, said game controller initiating and simultaneously continuing play of multiple ones of said plurality of games in response to user activation thereof.

In another embodiment, a method of playing an electronic game is provided. The method comprises: selecting a first game from a menu consisting of a plurality of games presented by an electronic gambling device; supplementing said selection of said first game by a further selection of an additional game from said menu of said plurality of games; and concurrently playing said first and said additional game.

While the method of the present invention has been described by way of examples, it will be understood by those skilled in the art that it is not intended to limit the invention to these examples. On the contrary, it is intended to cover all alternatives, modifications and equivalents as may be included within the spirit and scope of the invention. It is expected that some further objects, advantages, and features of the present invention shall become apparent from the ensuing description and as illustrated in the accompanying drawings.

BRIEF DESCRIPTION OF THE DRAWINGS

FIGS. 1–9, 11–13, 15–19, 21–26, and 28–36 depict schematic representations of different video display screens, of the type as might be shown on gaming machines in accordance with the present invention.

FIG. 10 depicts a video touch screen showing three conventional independent pay tables according to one embodiment of the present invention.

FIG. 14 depicts a video touch screen displaying a bonus pays video poker pay table according to one embodiment of the present invention.

FIG. 20 depicts draw poker hand frequencies according to an embodiment of the present invention.

FIG. 27 depicts a video touch screen displaying a bonus pays video poker pay table according to one embodiment of the present invention.

DETAILED DESCRIPTION OF THE PREFERRED EMBODIMENTS

The method of the present invention is to permit the player the option to play an independent game in a single game format independently, simultaneously, and/or in conjunction with other independent games. FIGS. 1–4 are basic illustrations displaying information and showing one example of how a player would play an independent game independently and FIGS. 5–12 show one example of how a player would play an independent game simultaneously and/or in conjunction with other independent games utilizing the method of game play of the present invention on a video touch screen gaming machine in a single game format.

The method of the present invention is also intended to permit the player to choose the combination of independent games e.g. different odds and pay tables, game styles, e.g., poker, keno, slot, bingo, blackjack, and the like, for a variety of monetary denominations, (5 cents, 25 cents, one dollar, etc.) and a variety monetary wagers, (1 coin, 2 coins, max bet, etc.). Permitting, in a multi game, denomination, and wager format, play of the games independently, simultaneously and/or in conjunction with other independent games.

Figure 28:
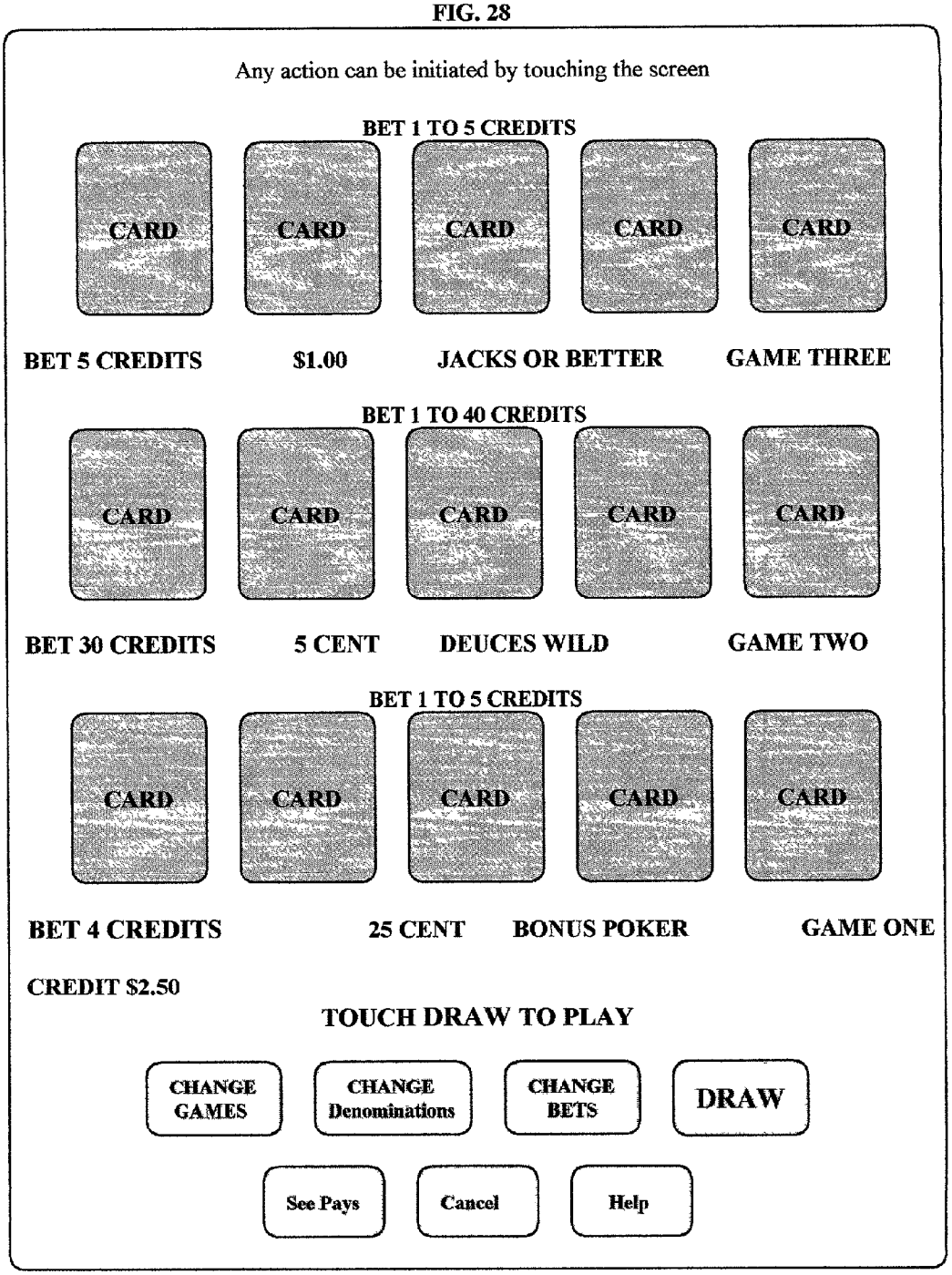

FIG. 28 is a basic display illustration of three independent poker games after the player has selected the games, denominations, and wagers from an electronic video touch screen gaming machine menu. The same method of game play is applied here as in FIGS. 1–11, only now in a multi-game, denomination, and wager format.

Using this method of game play, there is an unlimited number of independent game e.g. odds and pay tables, denomination, and wager combinations that can be played simultaneously and/or in conjunction with other independent games e.g. odds and pay tables, denominations, and wagers. This inventive technology thus creates new entertaining game play for the player while also allowing a higher volume of coin in for the casinos, with the player now allowed to wager on more than one game.

The method of the present invention is also intended to permit the player(s) to play an independent game in a single game format independently, simultaneously, and/or in conjunction with independent games from one or more electronic gaming machines. Should the player(s) choose to play more than one independent game at a time, the independent games (i.e. odds and pay tables), and wagers selected by the player(s) then become parameters in pay tables created from the predetermined indicia of the independent games to create New Games and/or New Bonuses.

FIGS. 13–19 are basic illustrations showing how a player(s) would become eligible for bonus pays, created by utilizing the method of game play on a video touch screen gaming machine in a single game format. FIGS. 21–26 are basic illustrations of how a player(s) would play a new game, to be referred hereinafter as BIG MONEY, created by utilizing the method of game play on a video touch screen gaming machine in a multi game format.

The method of the present invention is also intended to permit a player(s) to choose a combination of independent games game styles from one or more gaming apparatuses, as well as denominations and wagers in a multi-game format to be played simultaneously and/or in conjunction with other independent games e.g. different odds and pay tables, game styles, denominations, and wagers. The games e.g. different odds and pay tables and wagers selected by the player(s) then become parameters in pay tables created from the predetermined indicia of the independent games to thereby create New Games and/or New Bonuses.

Figure 29:
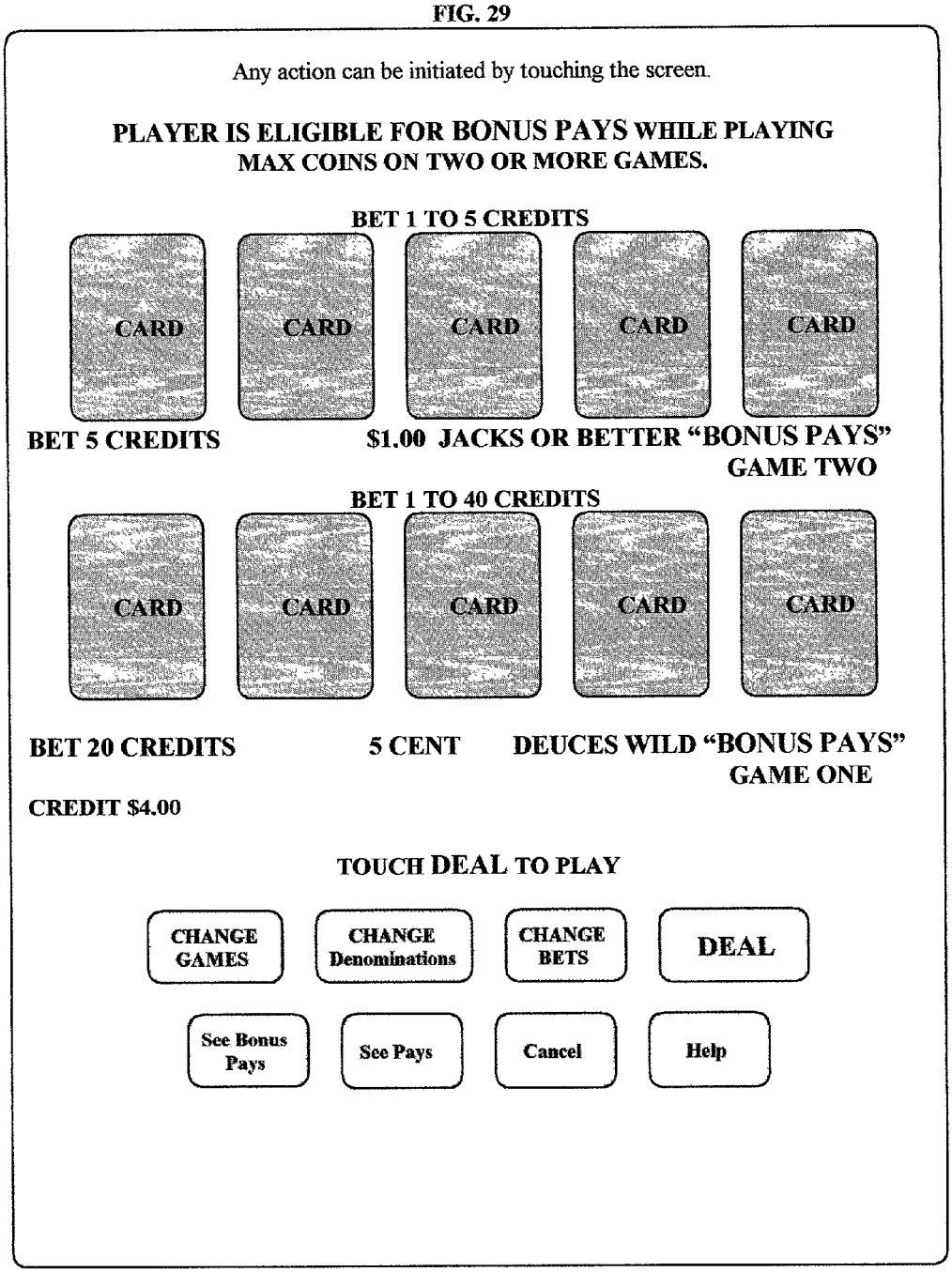

FIG. 29 is a basic illustration displaying information and two independent poker games with Bonus Pays after the player(S) has selected the games, denominations, and wagers from a menu on an electronic video touch screen gaming machine. The same method of game play is applied here as in FIGS. 13–19, only now in a multi-game, denomination, and wager format. FIG. 30 is a basic illustration displaying information and two independent poker games and the BIG MONEY after the player(s) has selected the games, denominations, and wagers from a menu located on an electronic video touch screen gaming machine. The same method of game play is applied here as in FIGS. 21–27, only now in a multi-game, denomination, and wager format.

A multi-game offers a player a set of games, {G1, G2, . . . , Gn} that may be played simultaneously. Each game, Gi, has an associated set of outcomes, {O1, O2, . . . , Om} that occur with probabilities {p1, p2, . . . , pm}. This preferred embodiment describes a bonus method based on combinations of outcomes of simultaneous games. Each game is played with independent wagers that may or may not be identical.

Total bonuses equal the sum of amounts bonused for each possible combination of outcomes times the probability of occurrence of the combination of outcomes. Let pi,j equal the probability of occurrence of outcome Oj of game Gi. The subscript j may have a different range for each game as each game may have a different set of outcomes. The total expectation of bonuses, B, for n simultaneous games is therefore:

the sum of B(i,j)(k,l)( . . . )(n,m) times pi,jpk,lp . . . pn, m for each outcome, j, l, . . . , m of each game i, k, . . . , n played (where m may have a different value for each of n games).

For example, let game 1 have three possible outcomes, game 2 have four possible outcomes and game 3 have five possible outcomes with associated probabilities p1,1, p1,2, p1,3, p2,1, p2,2, p2,3, p2,4, p3,1, p3,2, p3,3, p3,4, p3,5. Then there are 3*4*5=60 possible bonus expectations:

B(1,1)(2,1)(3,1)p1,1p2,1p3,1
B(1,2)(2,1)(3,1)p1,2p2,1p3,1
B(1,3)(2,1)(3,1)p1,3p2,1p3,1
B(1,1)(2,2)(3,1)p1,1p2,2p3,1
B(1,2)(2,2)(3,1)p1,2p2,2p3,1
•
•
•
B(1,3)(2,4)(3,5)p1,3p2,4p3,5

The sum of these expectations divided by the wager required to win a bonus is the amount by which the game percentage is increased. Assume that it is desired that all expectations be equal. Then each bonus expectation should equal the total expectation divided by 60 since there are 60 possible combinations. Further assume a wager of one cent ($0.01) and a bonus payback of 1% (0.01). Then any bonus expectation is:

B(1,1)(2,1)(3,1) p1,1p2,1p3,1=(0.01*0.01)/60 and the bonus amount to be paid on bonus combination of G1O1, G2O1, G3O1 is:

B(1,1)(2,1)(3,1)=(0.01*0.01)/60/(p1,1 p2,1 p3,1) From this point on, a simplified notation can be used to replace game numbers by position in a statement, i.e. B(1,1)(2,1)(3,1) and p1,1p2,1p3,1 become B111 and p1p2p3.

Continuing the example above let us arbitrarily assign values to outcome probabilities for each of the three games.

| | p |
|---|---|
| Game 1 | |
| Outcome 1 | 0.9 |
| Outcome 2 | 0.09 |
| Outcome 3 | 0.01 |
| Game 2 | |
| Outcome 1 | 0.8 |
| Outcome 2 | 0.1 |
| Outcome 3 | 0.07 |
| Outcome 4 | 0.03 |
| Game 3 | |
| Outcome 1 | 0.7 |
| Outcome 2 | 0.2 |
| Outcome 3 | 0.08 |
| Outcome 4 | 0.012 |
| Outcome 5 | 0.008 |

(probabilities for each game should add to 1.000)

Then bonus values in dollars (per penny wagered per percent of payback) equal:

*B*111=(0.01*0.01)/60/(0.9*0.8*0.7)=$0.000003306

*B*211=(0.01*0.01)/60/(0.09*0.8*0.7)=$0.00003306

*B*311=(0.01*0.01)/60/(0.01*0.8*0.7)=$0.0002976

*B*121=(0.01*0.01)/60/(0.9*0.1*0.7)=$0.000026455

*B*221=(0.01*0.01)/60/(0.09*0.1*0.7)=$0.00026455

*B*321=(0.01*0.01)/60/(0.01*0.1*0.7)=$0.002380952

*B*131 (0.01*0.01)/60/(0.9*0.07*0.7)=$0.000037792

•
•
•

*B*335=(0.01*0.01)/60/(0.01*0.07*0.008)
=$0.297619047

*B*145 (0.01*0.01)/60/(0.9*0.03*0.008)
=$0.007716049

*B*245=(0.01*0.01)/60/(0.09*0.03*0.008)
=$0.077160493

*B*345=(0.01*0.01)/60/(0.01*0.03*0.008)
=$0.694444444

The maximum bonus in this example is B345 and is equal to 69.444 times wager.

As a specific example let us consider three games of stud poker played simultaneously. For each game there are ten possible outcomes with probabilities:

| | |
|---|---|
| No pair | 0.501177394 |
| One pair | 0.422569027 |
| Two pairs | 0.047539015 |
| Three of a kind | 0.021128451 |
| Straight | 0.003924646 |
| Flush | 0.001965401 |
| Full house | 0.001440576 |
| Four of a kind | 0.000240096 |
| Straight flush | 0.000013851 |
| Royal flush | 0.000001539 |

There are 1000 possible bonus combinations which gives bonus values equal to:

[*Bxyz*=(0.01*0.01)/1000/(*px*py*pz*)]

*B*1 1 1=0.0000001/
(0.501177394*0.501177394*0.501177394)=$0.000000794

*B*2 1 1=0.0000001/
(0.422569027*0.501177394*0.501177394)=$0.000000942

*B*3 1 1=0.0000001/
(0.047539015*0.501177394*0.501177394)=$0.000008374

*B*4 1 1=0.0000001/
(0.021128451*0.501177394*0.501177394)=$0.000018842

•

*B*1 5 7=0.0000001/
(0.501177394*0.003924646*0.001440576)=$0.035291641

*B*2 5 7=0.0000001/
(0.422569027*0.003924646*0.001440576)=$0.041856766

*B*3 5 7=0.0000001/
(0.047539015*0.003924646*0.001440576)=$0.372060149

*B*4 5 7=0.0000001/
(0.021128451*0.003924646*0.001440576)=$0.837135340

•

*B*8 9 9=0.0000001/
(0.000240096*0.000013851*0.000013851)=$2,
170,964.97

*B*9 9 9=0.0000001/
(0.000013851*0.000013851*0.000013851)=$37,
631,940.40

•

*B*10 10 10=0.0000001/
(0.000001539*0.000001539*0.000001539)=$27,
433,684,550.00

This chart shows the awards to be paid a player who hits a given number of numbers on an 8-spot Keno ticket while simultaneously winning a given stud poker hand. Awards are for a 1% return for $1.00 bet.

| Poker Hand | No Pair | One Pair | Jacks or Better | Two Pair | Three of A Kind | Straight |
|---|---|---|---|---|---|---|
| KENO | DOLLARS | | | | | |
| HIT 0 | 0 | 0 | 0 | 0 | 0 | 0 |
| HIT 1 | 0 | 0 | 0 | 0 | 0 | 0 |
| HIT 2 | 0 | 0 | 0 | 0 | 0 | 0 |
| HIT 3 | 0 | 0 | 0 | 0 | 0 | 0 |
| HIT 4 | 0 | 0 | 0 | 0 | 0 | 0 |
| HIT 5 | 0 | 0 | 0 | 0 | 0 | 1 |
| HIT 6 | 0 | 0 | 0 | 0 | 1 | 6 |
| HIT 7 | 0 | 0 | 2 | 5 | 13 | 70 |
| HIT 8 | 13 | 22 | 50 | 139 | 313 | 1686 |

| Poker Hand | Flush | Full House | Four of A Kind | Straight Flush | Royal Flush |
|---|---|---|---|---|---|
| KENO | DOLLARS | | | | |
| HIT 1 | 0 | 0 | 1 | 27 | 245 |
| HIT 2 | 0 | 0 | 1 | 23 | 210 |
| HIT 3 | 0 | 0 | 2 | 35 | 316 |
| HIT 4 | 0 | 0 | 4 | 84 | 758 |
| HIT 5 | 2 | 3 | 18 | 316 | 2844 |
| HIT 6 | 13 | 18 | 109 | 1896 | 17068 |
| HIT 7 | 140 | 191 | 1148 | 19913 | 179223 |
| HIT 8 | 3367 | 4594 | 27569 | 477891 | 4301021 |

The format in which a game can be programmed to permit a player to be able to play independent games simultaneously and/or in conjunction with other independent games is unlimited. The format that is described below is very basic in order not to stray from the spirit and scope of the invention.

Figure 1:
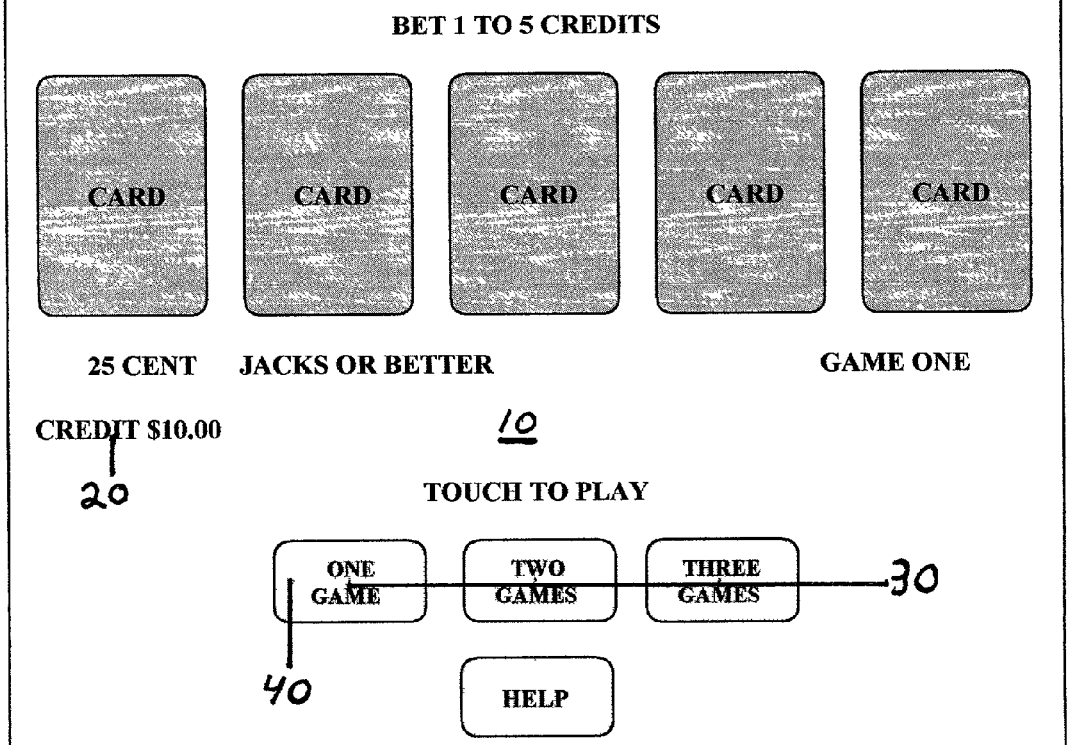

In a flowing format, the manner of play of game machines utilizing the present invention is set forth as follows:

FIG. 1 shows a representation of a video touch screen displaying information and a conventional Jacks or Better\25 cent\bet 1 to 5 credits video poker game in a single game format. Giving the player the option to play one, two or three games: Player chooses\one game.

FIG. 2 shows a representation of a video touch screen displaying information and a conventional Jacks or Better\25 cent\bet 1 to 5 credits video poker game in a single game format: Player selects play max credits, and deal.

FIG. 3 shows a representation of a video touch screen displaying information and a conventional Jacks or Better\25 cent\bet 1 to 5 credits video poker game in a single game format: Player receives five cards, holds two cards and selects draw.

FIG. 4 shows a representation of a video touch screen displaying information and a conventional Jacks or Better\25 cent\bet 1 to 5 credits video poker game in a single game format: Player receives 3 new cards; three of a kind winner paid 15 credits. Player selects play more games.

FIG. 5 shows a representation of a video touch screen displaying information and three independent conventional Jacks or Better\25 cent\bet 1 to 5 credits video poker game in a single game format: Player selects 3 games.

Figure 6:
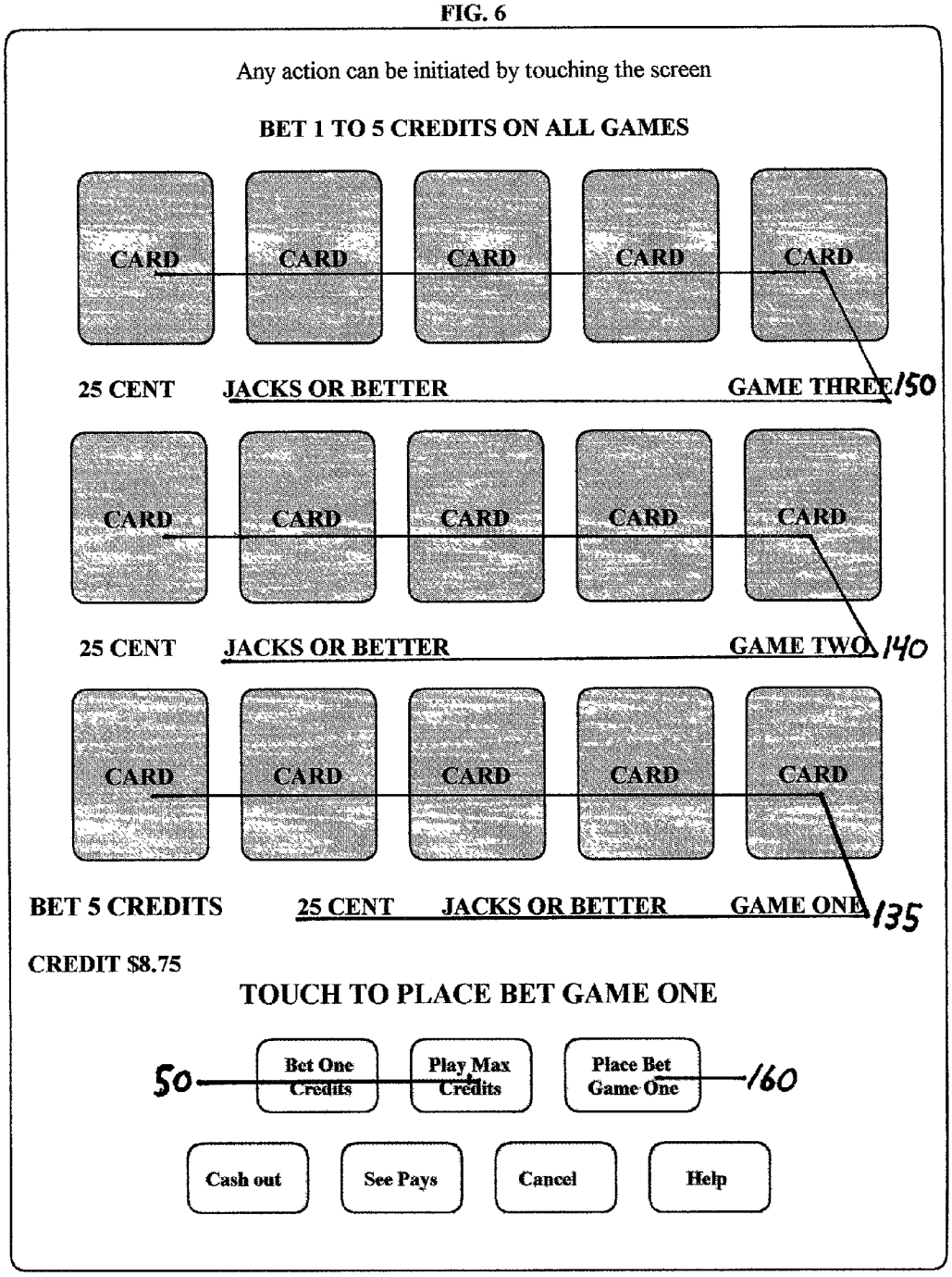

FIG. 6 shows a representation of a video touch screen displaying information and three independent conventional Jacks or Better\25 cent\bet 1 to 5 credits video poker game in a single game format: Player selects play max credits, and place bet game one.

Figure 7:
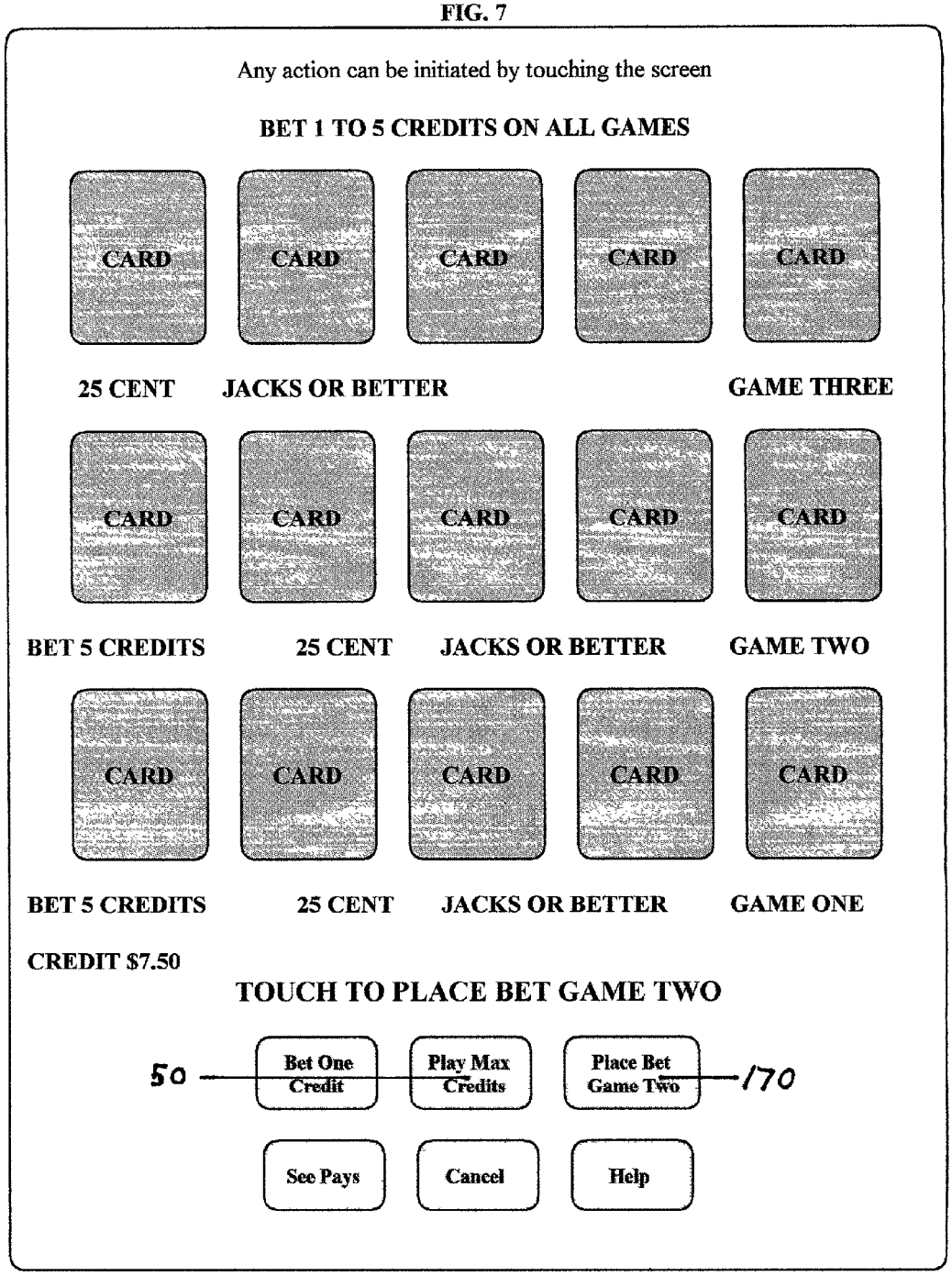

FIG. 7 shows a representation of a video touch screen displaying information and three independent conventional Jacks or Better\25 cent\bet 1 to 5 credits video poker game in a single game format: Player selects play max credits, and place bet game two.

Figure 8:
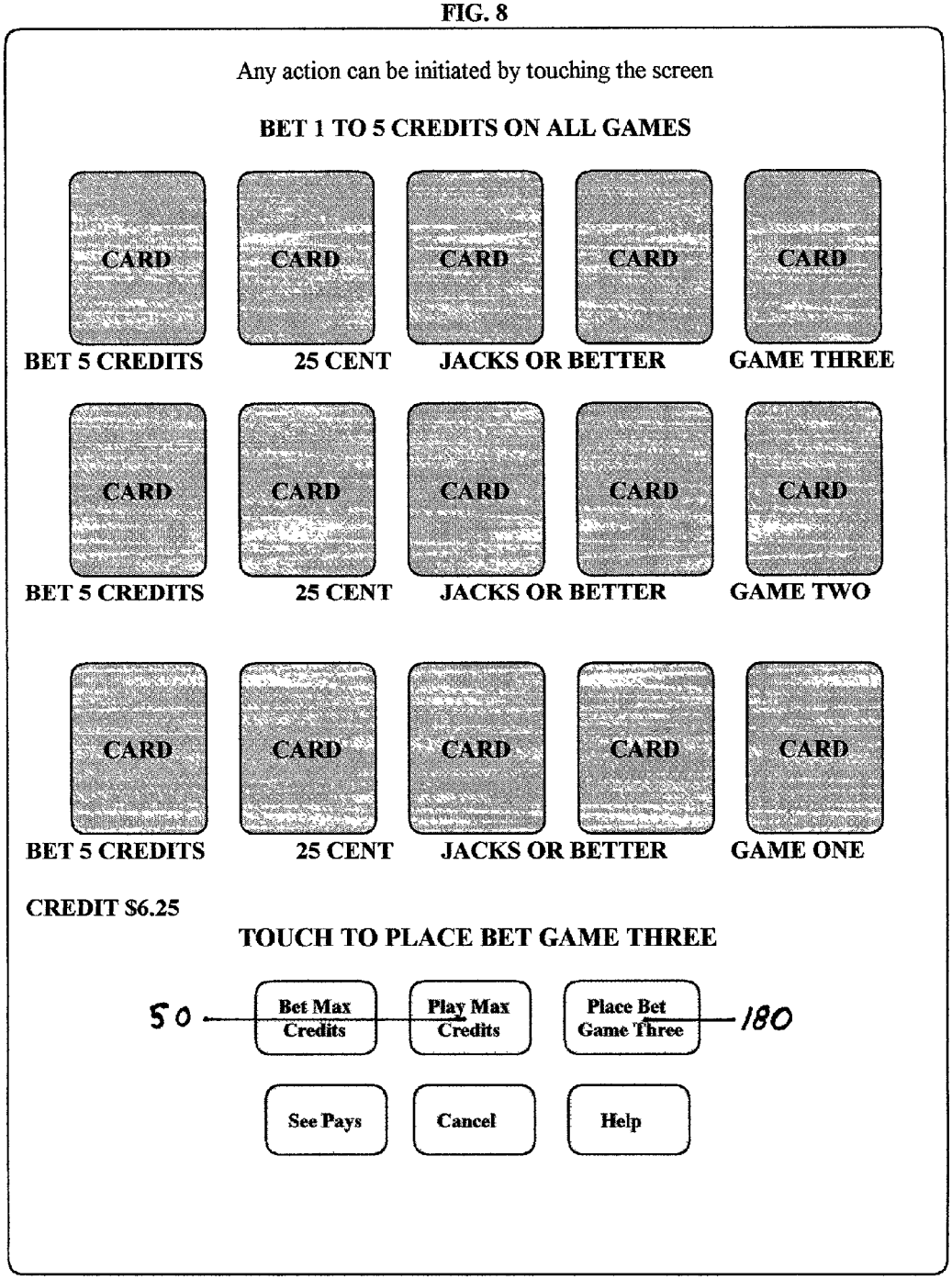

FIG. 8 shows a representation of a video touch screen displaying information and three independent conventional Jacks or Better\25 cent\bet 1 to 5 credits video poker game in a single game format: Player selects play max credits, and place bet game three.

Figure 9:
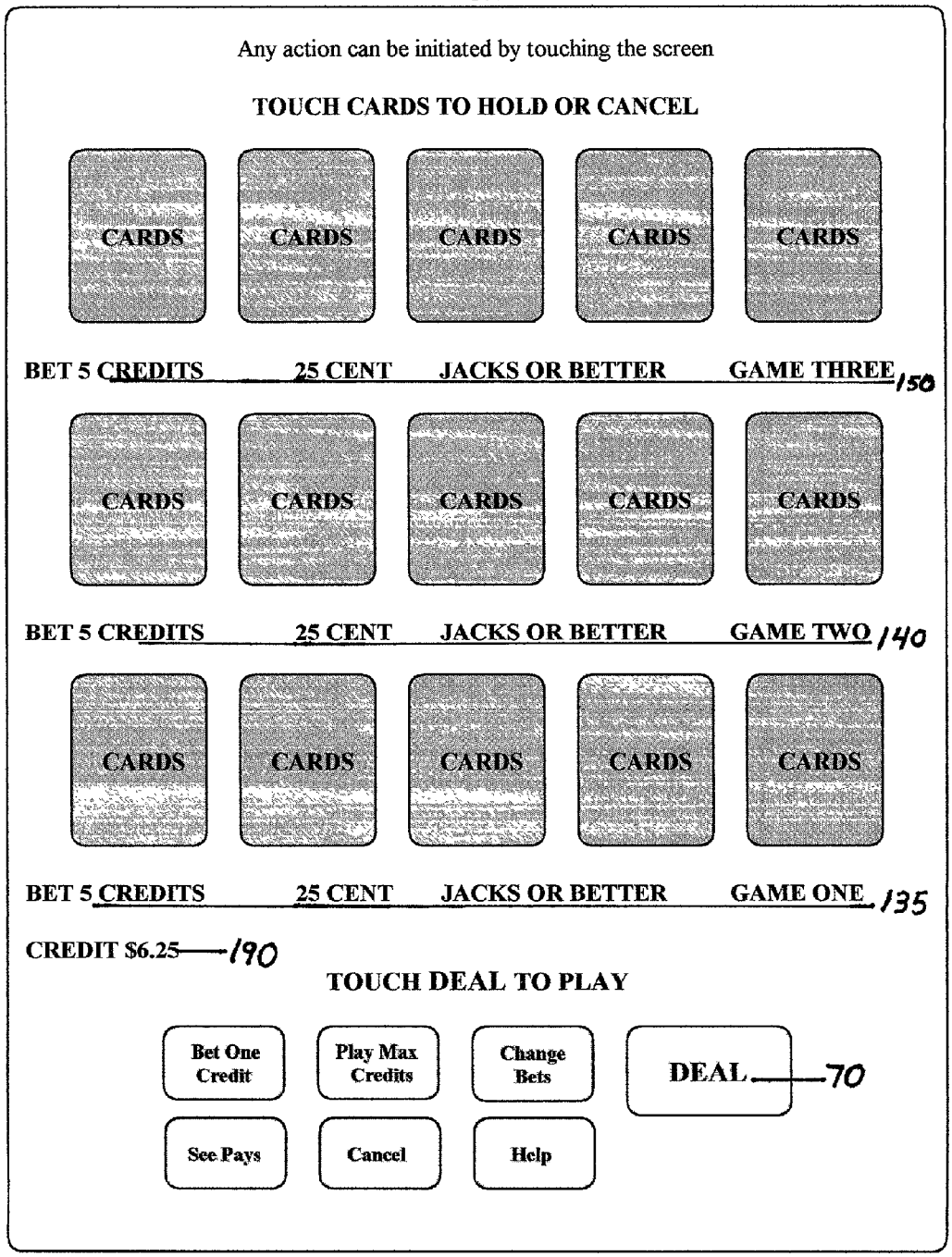

FIG. 9 shows a representation of a video touch screen displaying information and three independent conventional Jacks or Better\25 cent\bet 1 to 5 credits video poker game in a single game format: Player selects deal.

FIG. 10 shows a representation of a video touch screen displaying three independent conventional Jacks or Better\25 cent\Bet 1 to 5 credits video poker game pay tables.

Figure 11:
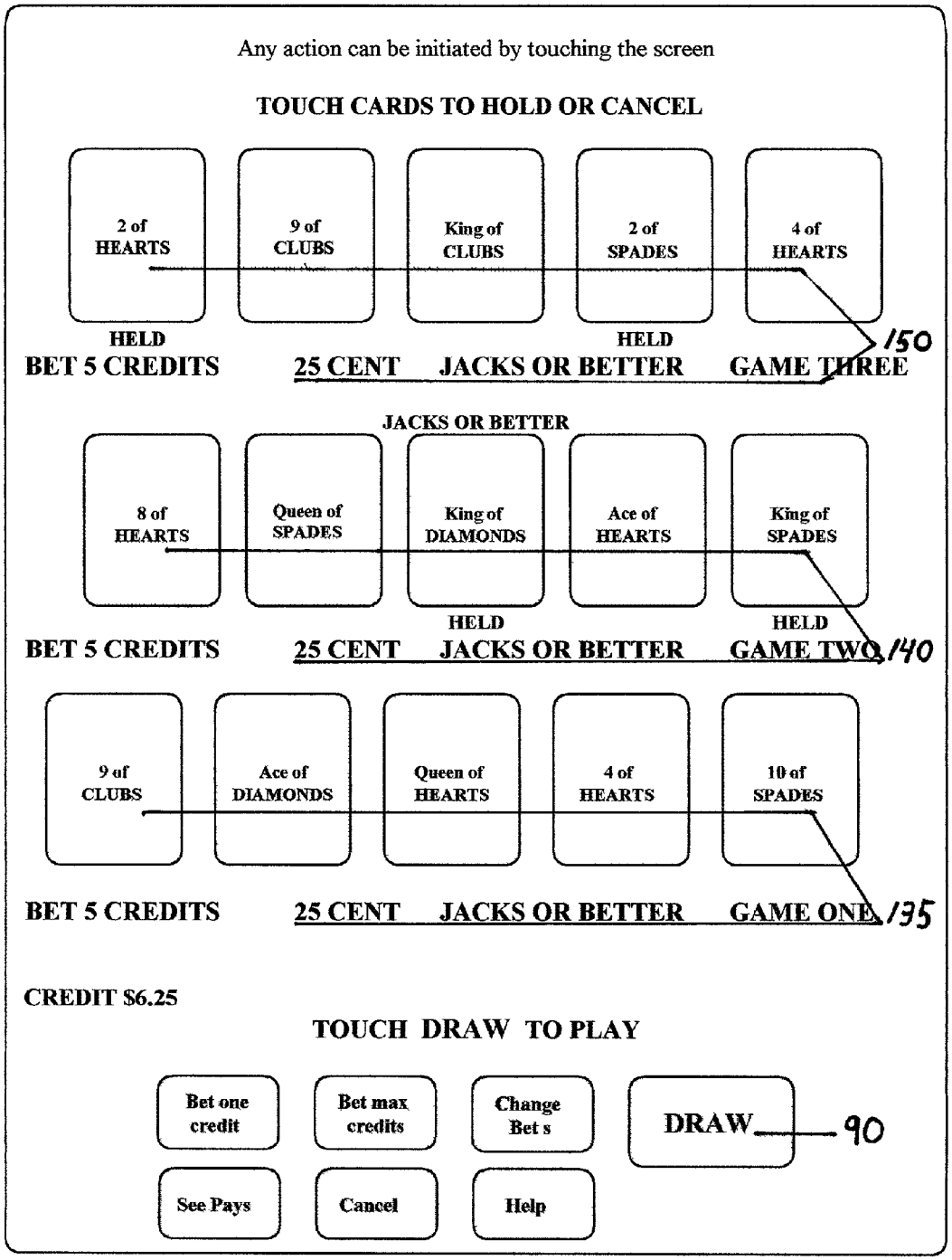

FIG. 11 shows a representation of a video touch screen displaying information and three independent conventional Jacks or Better\25 cent\bet 1 to 5 credits video poker game in a single game format: Player receives five cards game one; Player receives five cards, holds two game two; Player receives five cards, holds two game three; and Player selected draw.

Figure 12:
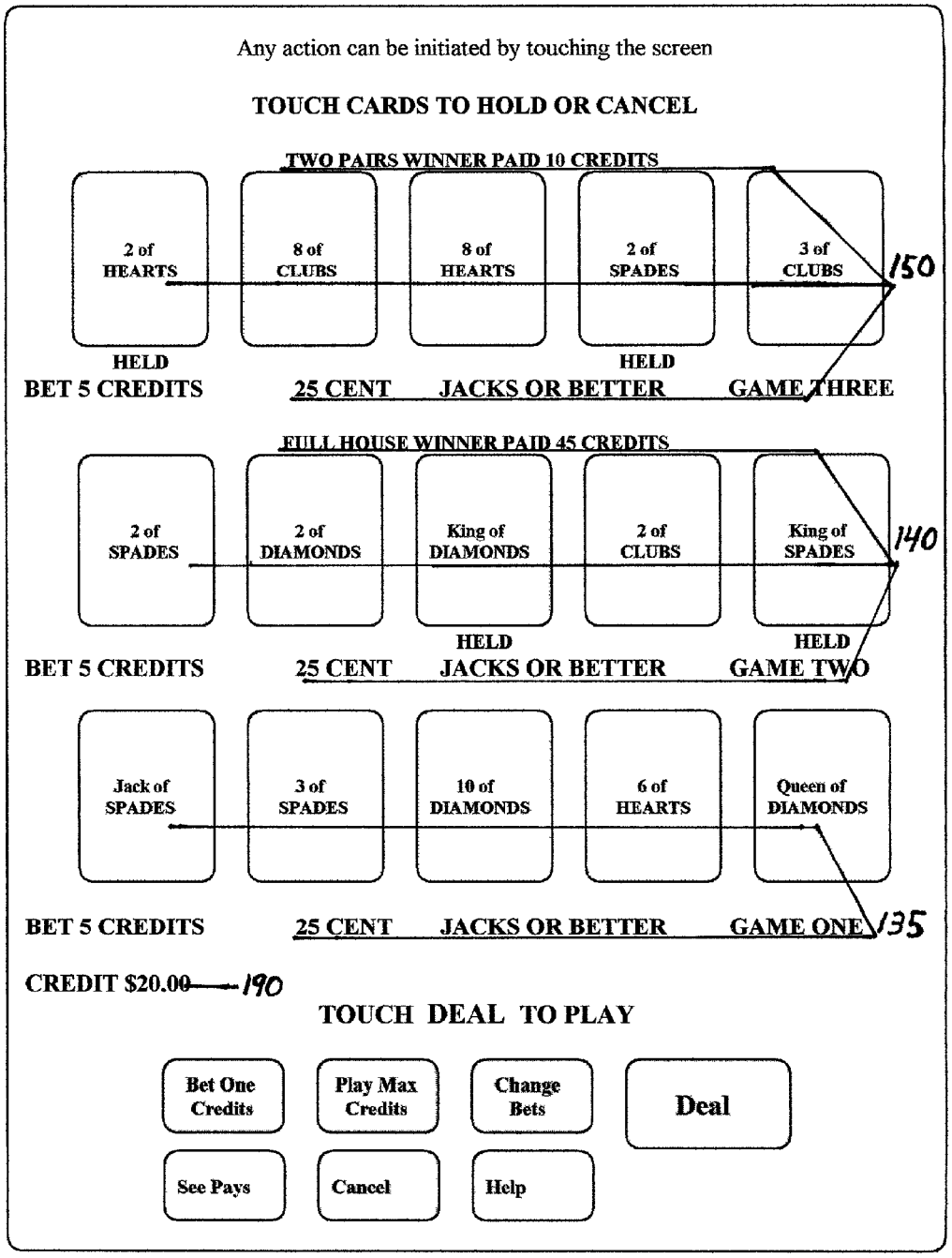

FIG. 12 shows a representation of a video touch screen displaying information and three independent conventional Jacks or Better\25 cent\bet 1 to 5 credits video poker game in a single game format: Player receives five new cards game one; Player receives three new cards, full house winner paid 45 credits game two; and Player receives three new cards; two pairs winner paid 10 credits game three.

FIG. 13 shows a representation of a video touch screen displaying information and a independent conventional Jacks or Better\25 cent\bet 1 to 5 credits with Bonus Pays video poker game in a single game format. Giving the player the option to play one, two or three games: Player selects two games.

FIG. 14 shows a representation of a video touch screen displaying information and a Bonus Pays video poker game pay table.

Figure 15:
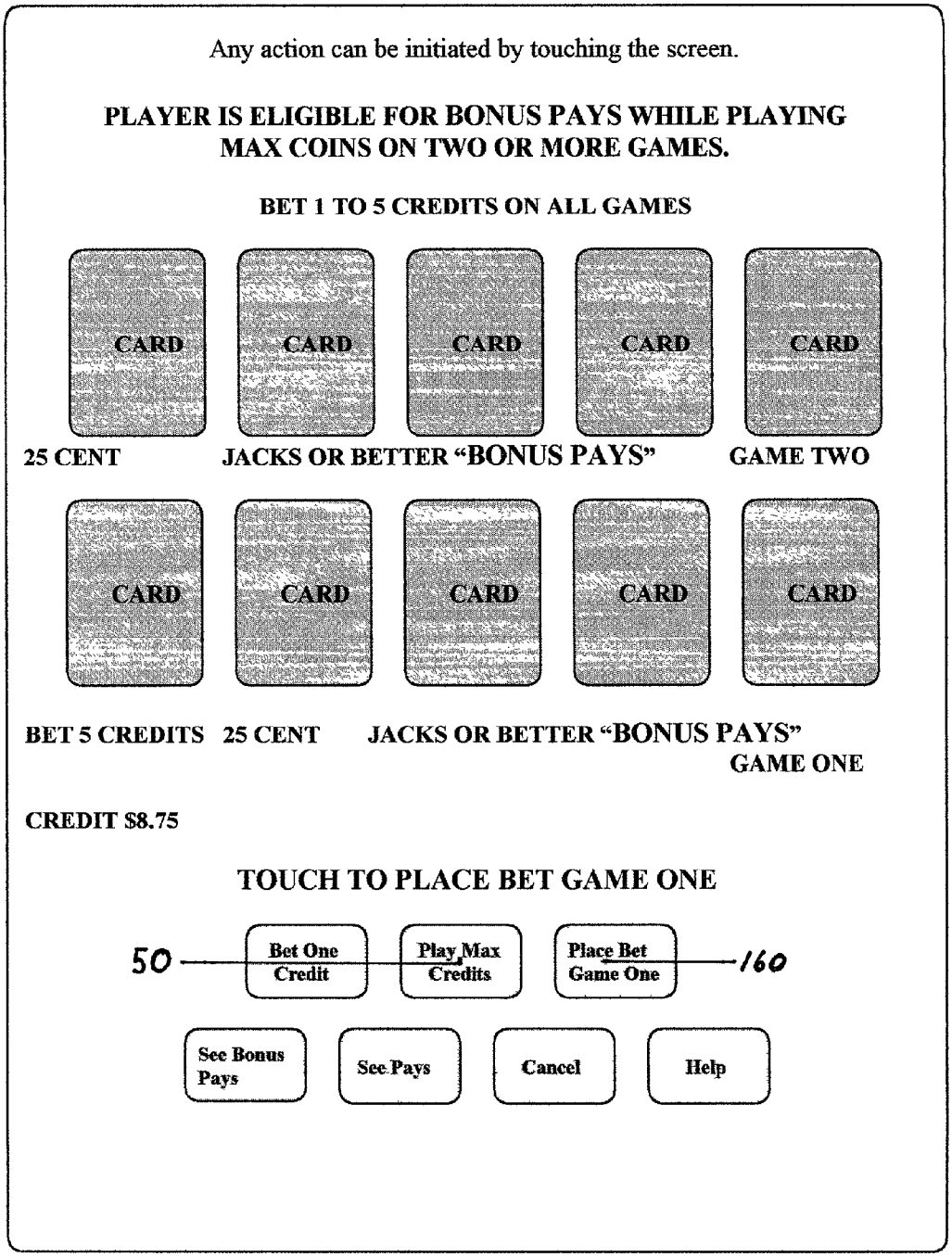

FIG. 15 shows a representation of a video touch screen displaying information and two independent conventional Jacks or Better\25 cent\bet 1 to 5 credits with Bonus Pays video poker game in a single game format: Player selects play max credits, and place bet game one.

Figure 16:
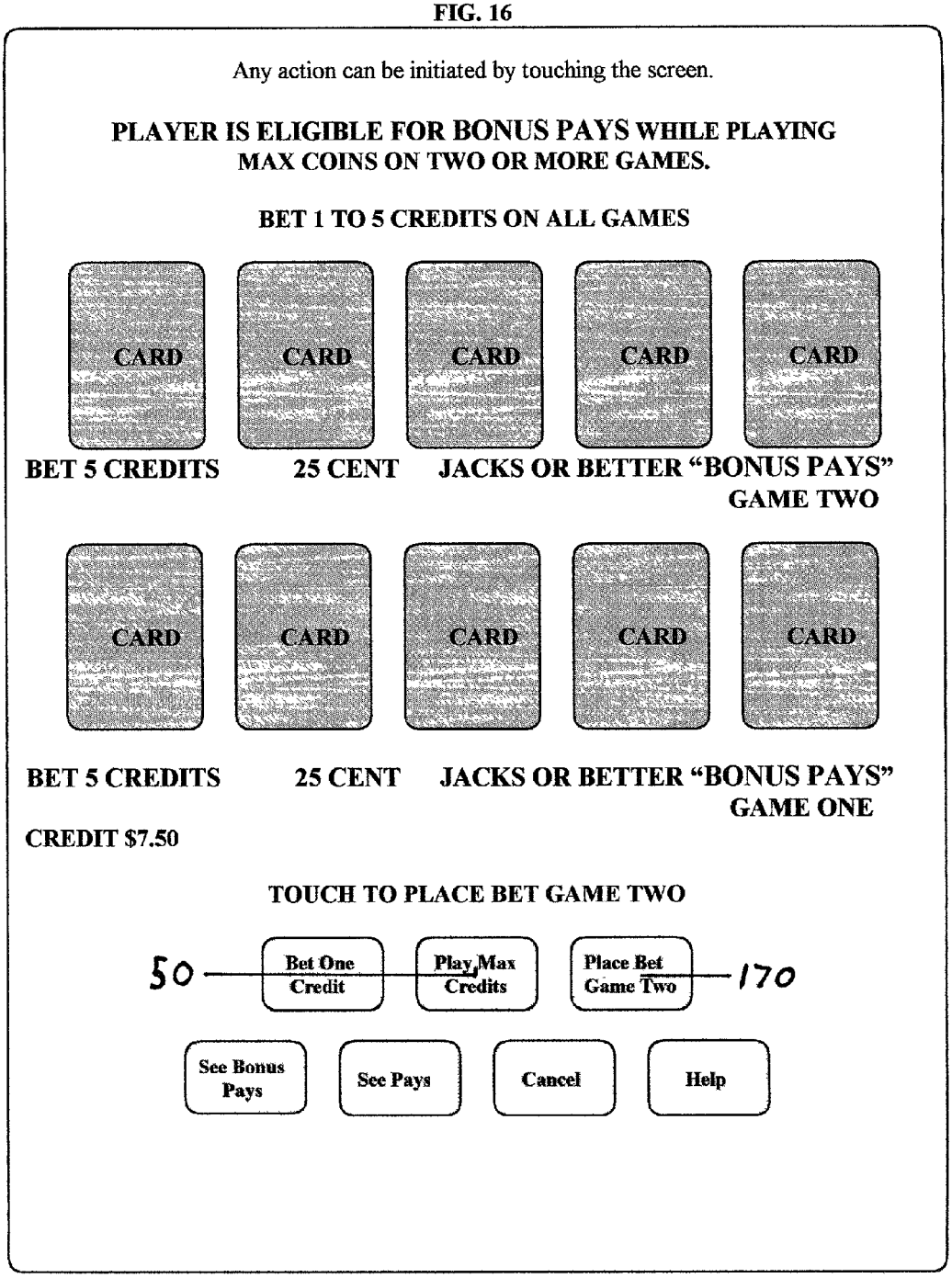

FIG. 16 shows a representation of a video touch screen displaying information and two independent conventional Jacks or Better\25 cent\bet 1 to 5 credits with Bonus Pays video poker game in a single game format: Player selects play max credits, and place bet game two.

Figure 17:
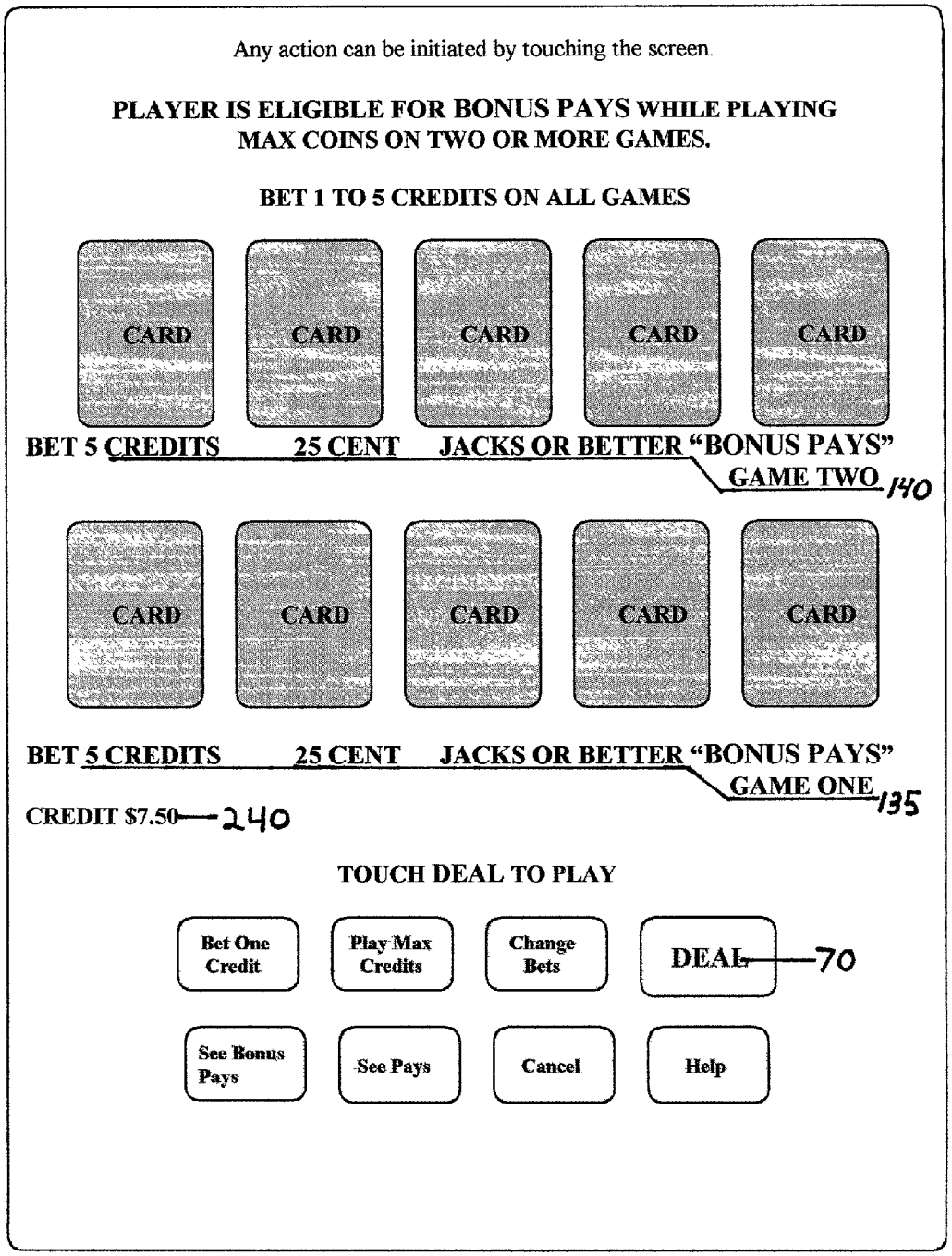

FIG. 17 shows a representation of a video touch screen displaying information and two independent conventional Jacks or Better\25 cent\bet 1 to 5 credits with Bonus Pays video poker game in a single game format: Player selects deal.

Figure 18:
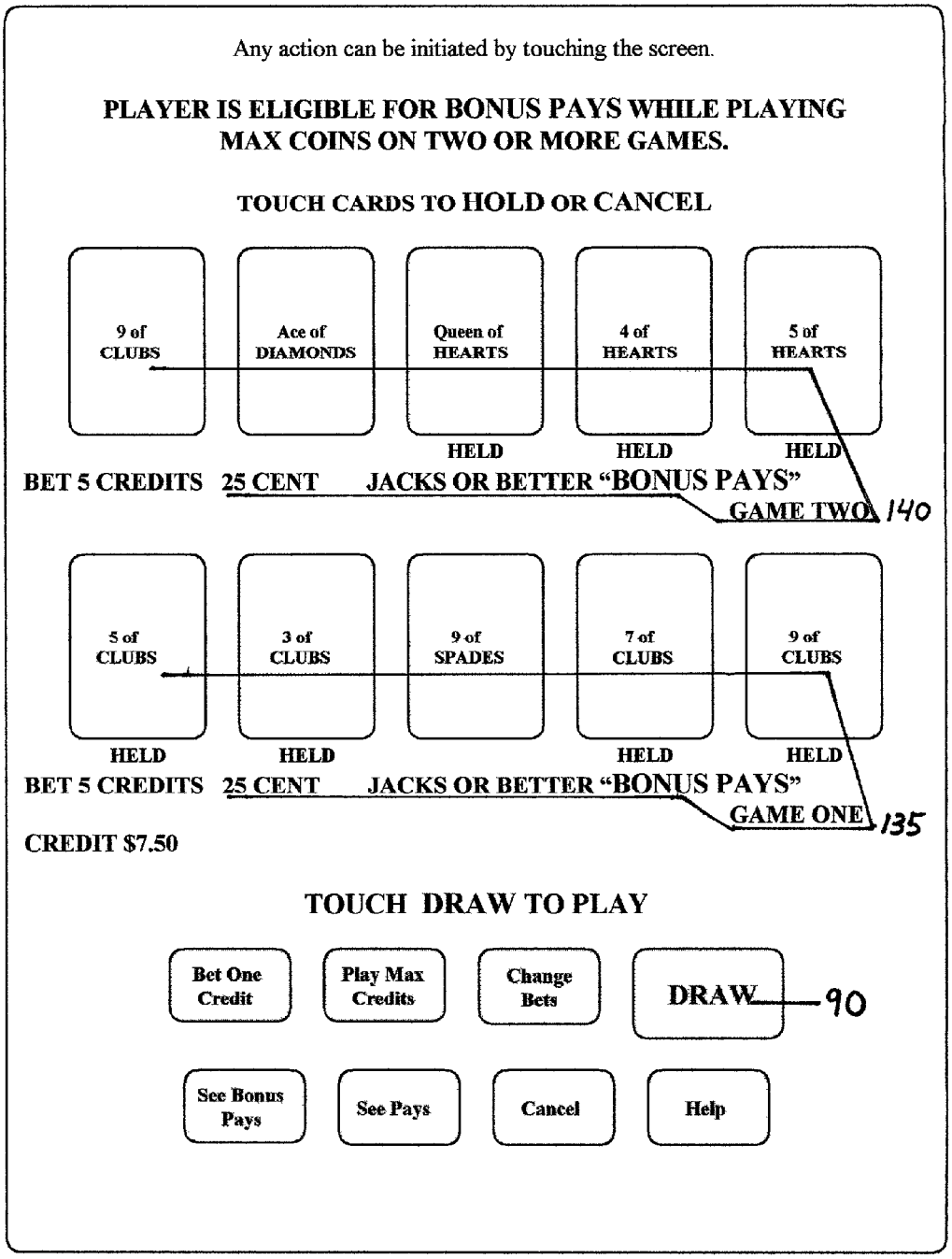

FIG. 18 shows a representation of a video touch screen displaying information and two independent conventional Jacks or Better\25 cent\bet 1 to 5 credits with Bonus Pays video poker game in a single game format: Player receives five cards, holds four cards game one; Player receives five cards, holds three cards game two; and Player selects draw.

Figure 19:
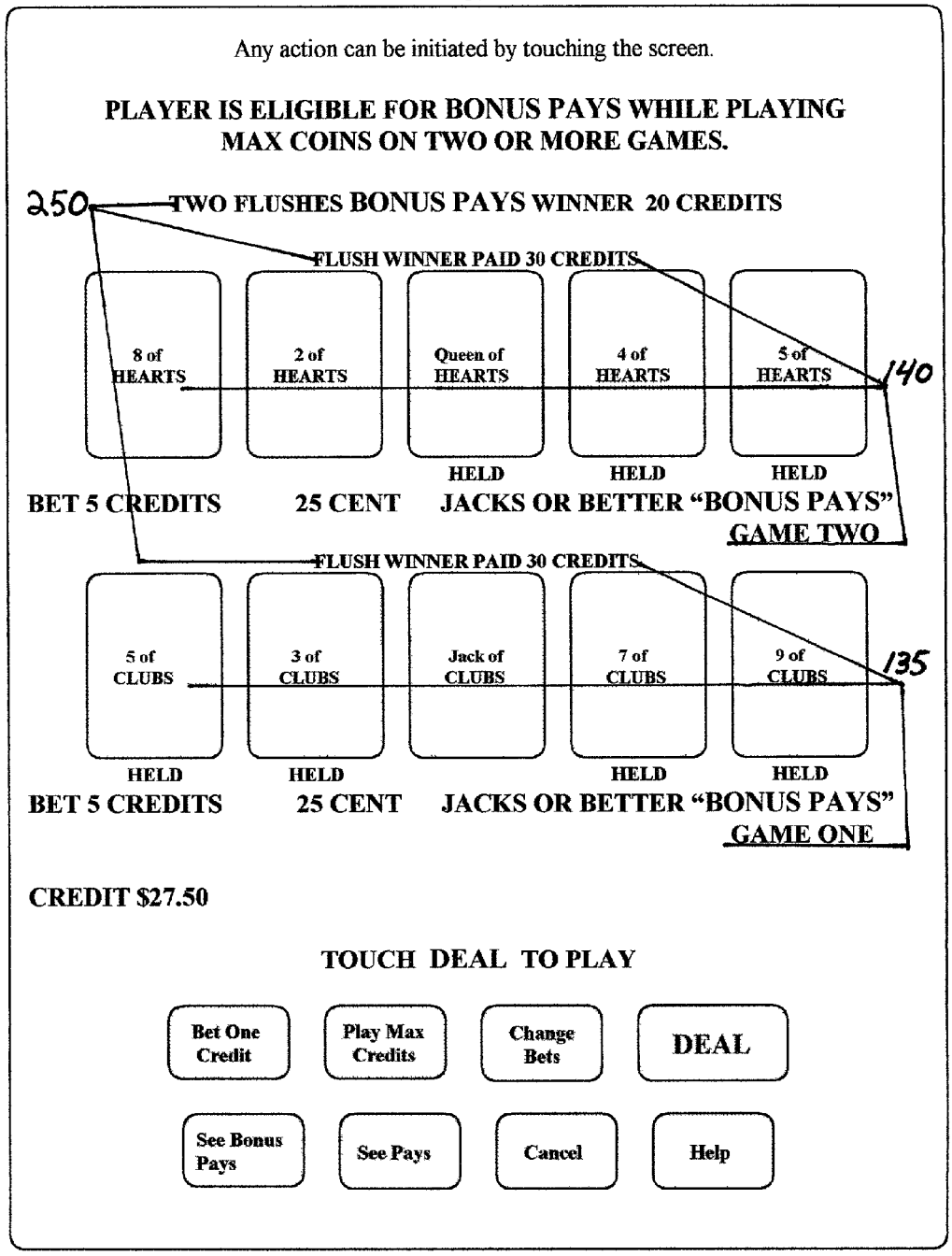

FIG. 19 shows a representation of a video touch screen displaying information and two independent conventional Jacks or Better\25 cent\bet 1 to 5 credits with Bonus Pays video poker game in a single game format; Player receives one new cards, flush winner paid 30 credits game one; and Player receives two new cards, flush winner paid 30 credits game two; and Player receives two flushes Bonus Pays winner 20 credits.

FIG. 20 shows a representation of a video touch screen displaying draw poker hand frequencies created from the method of the present invention.

FIG. 21 shows a representation of a video touch screen displaying information and an independent conventional Jacks or Better\25 cent\bet 1 to 5 credits and Big Money video poker games in a multi game format: Player selects two games and BIG MONEY.

FIG. 22 shows a representation of a video touch screen displaying information and two independent conventional Jacks or Better\25 cent\bet 1 to 5 credits and Big Money video poker games in a multi game format: Player selects bet max credits and place bet game one.

FIG. 23 shows a representation of a video touch screen displaying information and two independent conventional Jacks or Better\25 cent\bet 1 to 5 credits and Big Money video poker games in a multi game format: Player selects bet max credits and place bet game two.

Figure 24:
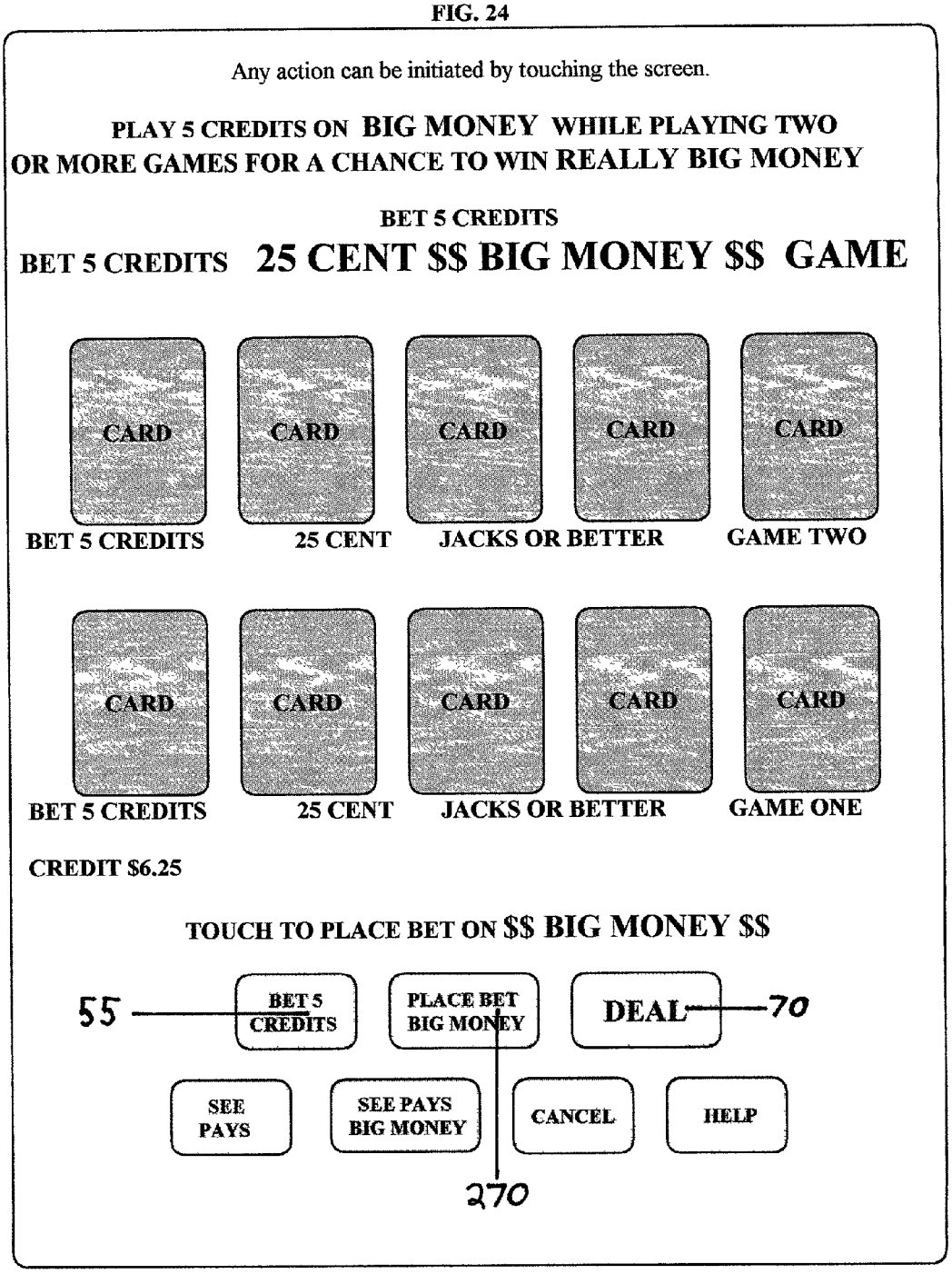

FIG. 24 shows a representation of a video touch screen displaying information and two independent conventional Jacks or Better\25 cent\bet 1 to 5 credits and Big Money video poker games in a multi game format: Player selects bet 5 credits and place bet Big Money; and Player selects deal.

Figure 25:
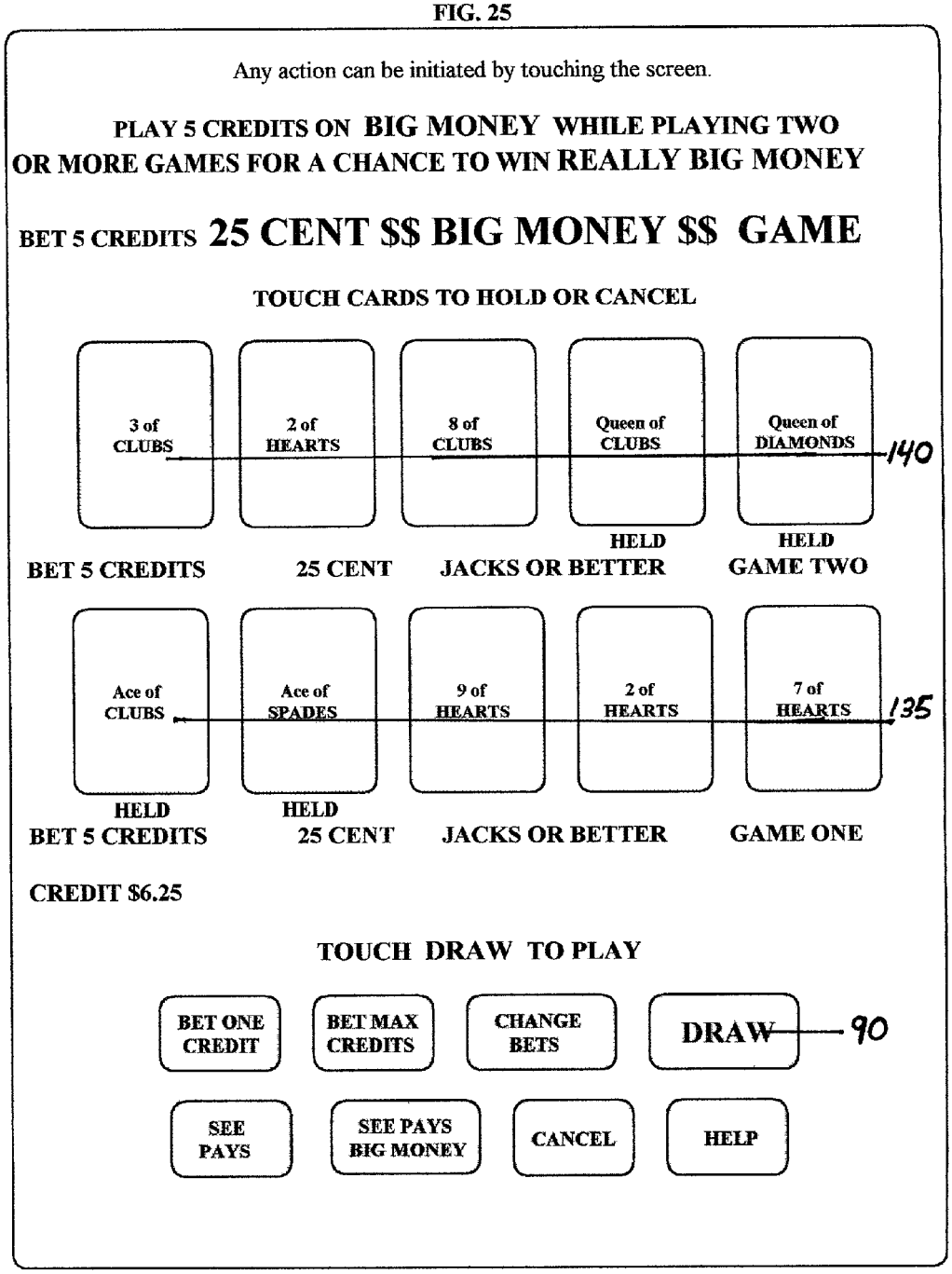

FIG. 25 shows a representation of a video touch screen displaying information and two independent conventional Jacks or Better\25 cent\bet 1 to 5 credits and Big Money video poker games in a multi game format: Player receives five cards, holds two cards game one; Player receives five cards, holds two cards game two; and Player selects draw.

Figure 26:
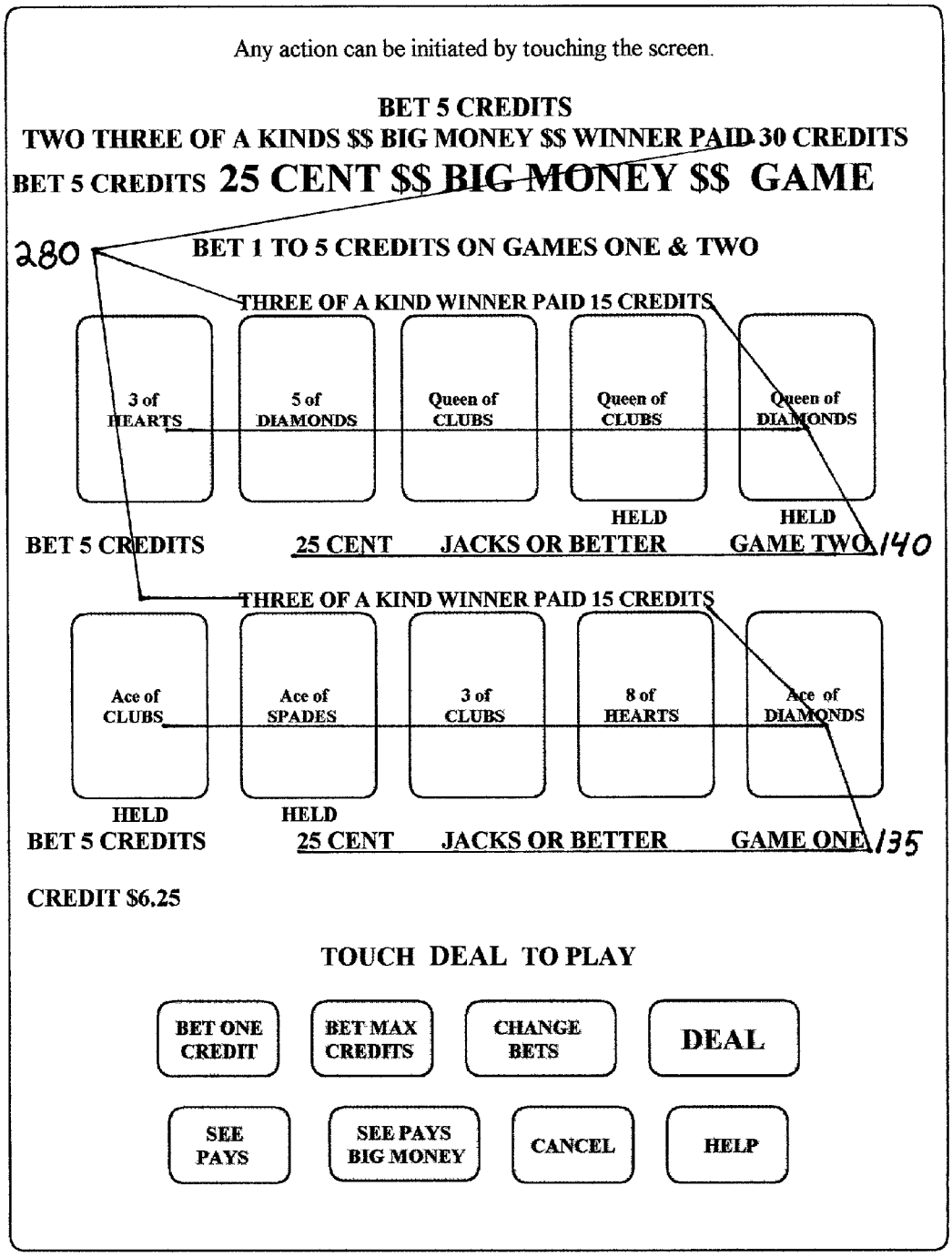

FIG. 26 shows a representation of a video touch screen displaying information and two independent conventional Jacks or Better\25 cent\bet 1 to 5 credits and Big Money video poker games in a multi game format: Player receives three new cards, three-of-a-kind winner paid 15 credits game one; Player receives three new cards, three-of-a-kind winner paid 15 credits game two; and Player receives two three-of-a-kinds BIG MONEY winner paid 30 credits.

FIG. 27 shows a representation of a video touch screen displaying information and a Big Money video poker games pay table.

FIG. 28 shows a representation of a video touch screen displaying information and three independent video poker games in a multi game, denomination and wager format.

FIG. 29 shows a representation of a video touch screen displaying information and two independent video poker games with Bonus Pays in a multi game, denomination and wager format.

FIG. 30 a representation of a video touch screen displaying information and two independent video poker games and Big Money in a multi game, denomination and wager format.

Reference is now made to the drawings wherein like numerals refer to like features throughout.

In conventional video poker, an electronic gaming machine is programmed to display a five-card hand dealt from a standard deck of fifty-two playing cards. The player bets one to five coins and activates the "Deal" button (or receives the initial deal automatically if the maximum number of coins are bet) to receive the initial deal of five cards. After the initial deal of the cards, the player may hold any of the initially dealt cards and then the player may select the "Draw" button to receive replacement cards. The player receives a payout on the resulting hand if the player achieves one of the pre-designated poker hand combinations shown on the payout schedule. The player bases the amount of the payout on the number of coins bet.

To describe the method of the present invention, the same conventional video poker game play as is describe above will be used. As will be understood by people skilled in the art, in order for the method of the present invention to work, the electronic gaming machine must be suitably programmed to add these additional features.

FIGS. 1–4 are basic illustrations showing how a player would play an independent conventional video poker game on a video touch screen gaming machine in a single game format using the method described above. Under the present invention, however, the player has the option to choose between One Game, Two Games or Three Games (and as is conventionally the case, any action can be initialized by touching the screen).

FIG. 1 shows a representation of a video touch screen 10 displaying information and an independent conventional Jacks or Better\25 cent\bet one to five credit video poker game, with (based on theoretical probabilities) a payback percentage of approximately 96%. Also shown is a typical payout schedule that is used in electronic video draw poker machines. In order to activate the gaming machine the player inserts money into the coin entry or bill validator (not shown). Player inserts $10.00 into bill validator (not shown), credit $10.00 (Ref Num 20). Player now has the option to select One Game, Two Games or Three Games 30. In this example, Player selects One Game 40.

In FIG. 2, Player selects play max credits 50; a bet of 5 credits is displayed 60. To start play, Player selects Deal 70. In FIG. 3, five cards are displayed, with Player holding the 2 of Hearts and the 2 of Spades in game one 80. Player selects Draw 90.

In FIG. 4, three new cards are displayed: the 2 of Clubs, the Ace of Diamonds and the Queen of Spades (game one 80). Player receives three of a kind, and Player wins 15 credits 110 (credit $11.25 120). Player selects play more games 125.

FIG. 5–11 are basic illustrations displaying information and showing how a player would play an independent game simultaneously and/or in conjunction with other independent games using the method of the present invention on a video touch screen gaming machine in a single game format.

FIG. 5, is a representation of a video touch screen displaying information—independent conventional Jacks or Better\Bonus Pays\25 cent\bet one to five coin video poker game, with the option to play one, two or three games.

In order to activate the gaming machine the player inserts money into the coin entry or bill validator (not shown). In this example, Player inserts a $10.00 into bill validator (not shown)—credit $10.00 200. Player selects Three games.

FIG. 6 is a representation of a video touch screen displaying information and three independent conventional Jacks or Better\25 cent\bet one to five credit video poker games—Game one 130, Game two 140, and Game three 150. Player selects play max credits 50 and places bet game one 160. In FIG. 7 Player selects play max credits 50 then selects place bet game two 170. In FIG. 8, Player selects play max credits 50 then selects place bet game three 180.

In FIG. 9, a representation of a video touch screen displaying information, requiring three independent Jacks or better\25 cent video\Bet 1 to 5 credit poker games, before the player activates game play. Player bets five credits game one 130, bets five credits game two 140, and bets five credits game three 150 (credit $6.25 190).

FIG. 10 is a representation of the three independent 25 cent\Jacks or better\bet one to five credits pay tables for game one, two, and three.

In FIG. 9, Player selects Deal 70. FIG. 11 is a representation of a video touch screen displaying information and five cards displayed game one 130. Five cards displayed, player holds King of Spades and King of Diamonds game two 140. Five cards displayed, player holds Two of Hearts and Two of Spades game three 150. Player selects Draw 90.

In FIG. 12 five new cards are displayed game one 130, in game two three new cards are displayed 2 of Spades, 2 of Diamonds and the 2 of Clubs. Player receives a full house, winner is paid 45 credits on game two 140, and in game three, three new cards are displayed 8 of Clubs, 8 of Hearts and the 3 of Clubs. Player receives two pairs, and winner is paid 10 credits on game three 150 (credit $22.00 190).

FIGS. 13–19 are basic illustrations showing how a player would become eligible for bonus pays, using the method of the present invention on a video touch screen gaming machine in a single game format.

FIG. 13 is a representation of a video touch screen displaying information—independent conventional Jacks or Better\Bonus Pays\25 cent\bet one to five coin video poker game, with the option to play one, two or three games.

In order to activate the gaming machine the player inserts money into the coin entry or bill validator (not shown). In this example, Player inserts a $10.00 into bill validator (not shown)—credit $10.00 200. This is the same video poker game illustrated in FIG. 1, only now the player can become eligible for bonus pays by playing max coins on two or more games 210. FIG. 13 Player selects two games 220 (see bonus pays 230, FIG. 14 as an example of a bonus pays pay table). Player is eligible for bonus pays while playing max coins on two or more games. Player wins if he or she receives two or more Royal Flushes, Straight Flushes, Four of a kinds, Full Houses, Flushes, Straights, Three of a Kinds, Two Pairs, or Jacks or Better.

If the Player chooses to play more than one independent game at a time, the independent games selected by the player then become parameters in pay tables created from the predetermined indicia, for example, Royal Flush, Four of a kind, etc., of the independent games to create bonus pays.

In FIG. 15, Player selects: play max credits 50, and places this bet game one 130. In FIG. 16, Player selects: play max credits 50, in placing bet in game two 140.

FIG. 17 is a representation of a video touch screen displaying information and two independent Jacks or better\Bonus Pays\25 cent\Bet 1 to 5 credits video poker games, before the player activates game play. As shown, the Player bets five credits in game one 130, and bets five credits in game two 140 (credit $7.50 240). Player selects Deal 70.

In FIG. 18, five cards are displayed, Player holds 5, 3, 7, and 9 of Clubs game one 130. Five cards are displayed, player holds Queen, 4, and 5 of Hearts game two 140. Player selects Draw 90.

In FIG. 19 one new card is displayed: Jack of Clubs, and Player receives a Flush—winner paid 30 credits on game one 130. Two new cards are displayed 8 and 2 of Hearts, and Player receives a Flush—winner paid 30 credits on game two 140. Player having received Two Flushes obtains a Bonus Pays—winner 20 credits 250.

FIG. 20 is a representation of draw poker hand frequencies created from the method of the present invention. By allowing the player the option to play more than one game at a time, the interplay of the independent game hand frequencies creates combination game hand frequencies with low odds that can be used for bonus pays and new games.

FIGS. 21–26 are basic illustrations of how a player would play a new game, to be referred hereinafter as BIG MONEY, created by utilizing the method of the present invention on a video touch screen gaming machine in a multi game format (see Big Money Pays 230, with FIG. 27 an example of a Big Money pay table). Player is eligible for Big Money while playing two or more games and betting 5 credits on Big Money. Player wins if he or she receives two or more Royal Flushes, Straight Flushes, Four of a kinds, Full Houses, Flushes, Straights, Three of a Kinds, Two Pairs, or Jacks or Better.

If the Player chooses to play more than one independent game at a time, the independent games selected by the player then become parameters in pay tables created from the predetermined indicia, for example, Royal Flush, Four of a kind, etc., of the independent games to create Big Money.

FIG. 21 is a representation of a video touch screen displaying information and an independent conventional jacks or Better\25 cent\bet one to five credits and BIG MONEY\25 cent\5 credits video poker games. In order to activate the gaming machine the player inserts money into the coin entry or bill validator (not shown). In the present example, Player inserts $10.00 into a bill validator—credit $10.00 125. This is the same video poker game illustrated in FIG. 1, only now if the player chooses to play two or more games he or she can also play BIG MONEY.

Player selects two games 220 and BIG MONEY 260. In FIG. 22 player selects play max credits 50 then selects place bet game one 130. In FIG. 23, Player selects play max credits 50 then selects place bet game two 140. In FIG. 24, Player selects play max credits 50 then selects place bet BIG MONEY 270. Player then selects Deal 70.

In FIG. 25, five cards are displayed, player holds Ace of Clubs and Ace of Spades in game one 130. In game 2, five cards are displayed, with Player holding the Queen of Clubs and the Queen of Diamonds 140. Player selects Draw 90.

In FIG. 26, in game one three new cards are displayed, the 3 of Clubs, 8 of Hearts, and the Ace of Diamonds. Player receives three-of-a-kind—winner paid 15 credits on game one 130. In game two, three new cards are displayed: the 3 of Hearts, 5 of Diamonds, and the Queen of Clubs. Player receives three-of-a-kind—winner paid 15 credits game two 140. Player received two three-of-a-kinds, BIG MONEY winner paid 30 credits 280. FIG. 28 shows a representation of a video touch screen displaying information and three independent video poker games in a multi game, denomination and wager format.

FIG. 29 shows a representation of a video touch screen displaying information and two independent video poker games with Bonus Pays in a multi game, denomination and wager format. FIG. 30 shows a representation of a video touch screen displaying information and two independent video poker games and Big Money in a multi game, denomination and wager format.

FIG. 31 is a representation of a video touch screen displaying information, MACHINE ONE'S identification for group play 500 and an independent conventional jacks or Better\25 cent\bet one to five credits and video poker games. This is the same video poker game illustrated in FIG. 1, only now the player on MACHINE 1 chooses to participate in BIG MONEY GROUP PLAY 510.

Figure 32:
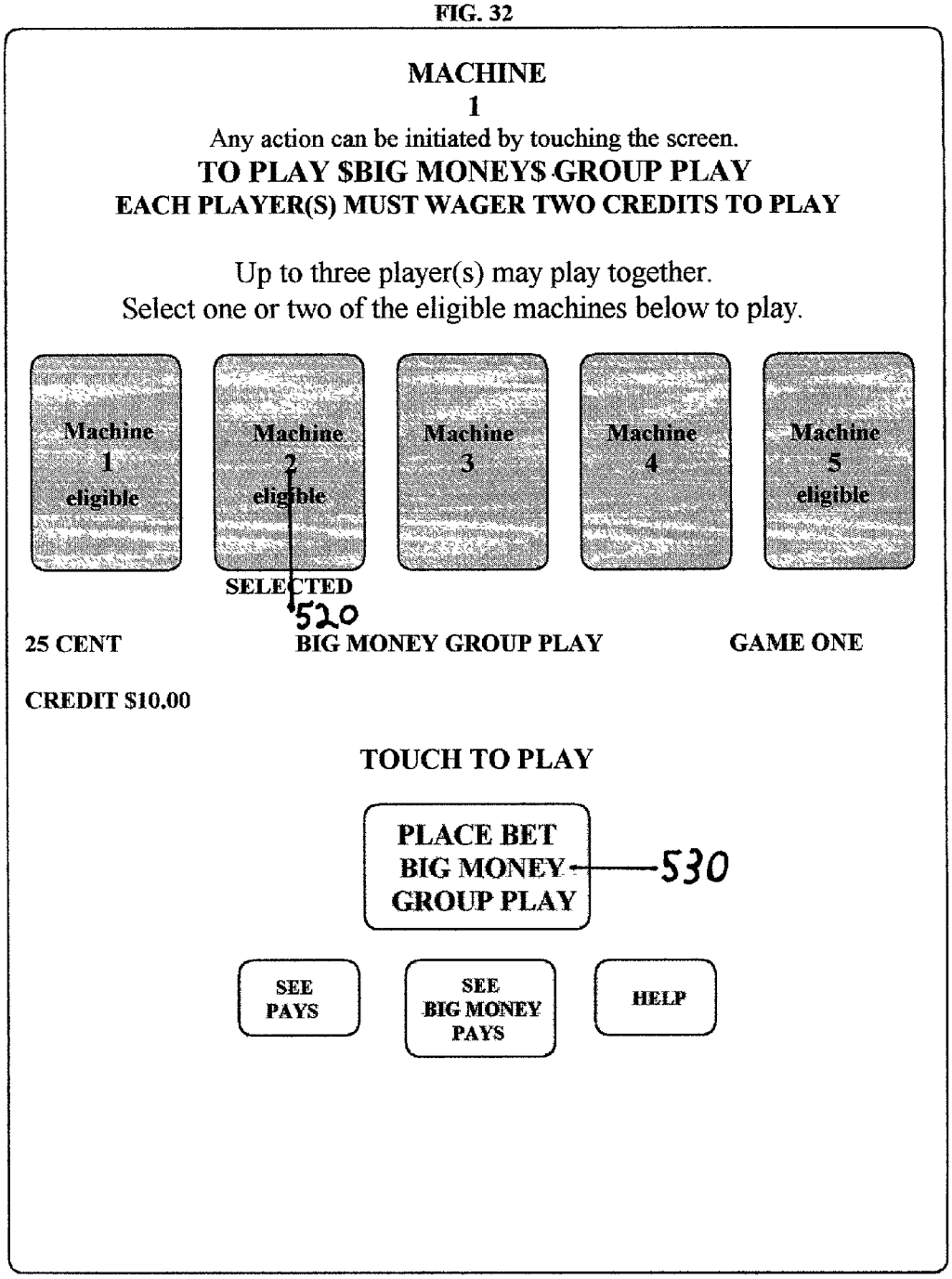

In FIG. 32 player on MACHINE 1 selects to play with another player on eligible MACHINE 2 520 and also selects to place bet on BIG MONEY GROUP PLAY 530. FIG. 33 shows a representation of a video touch screen displaying information and BIG MONEY GROUP PLAY bet two credits 540 and MACHINES 1&2 are participating in BIG MONEY GROUP PLAY 550.

FIG. 34 is a representation of a video touch screen displaying information, MACHINE TWO'S identification for group play 560 and an independent conventional jacks or Better\25 cent\bet one to five credits and video poker games. This is the same video poker game illustrated in FIG. 1, only now the player chooses to participate in BIG MONEY GROUP PLAY 570.

Figure 35:
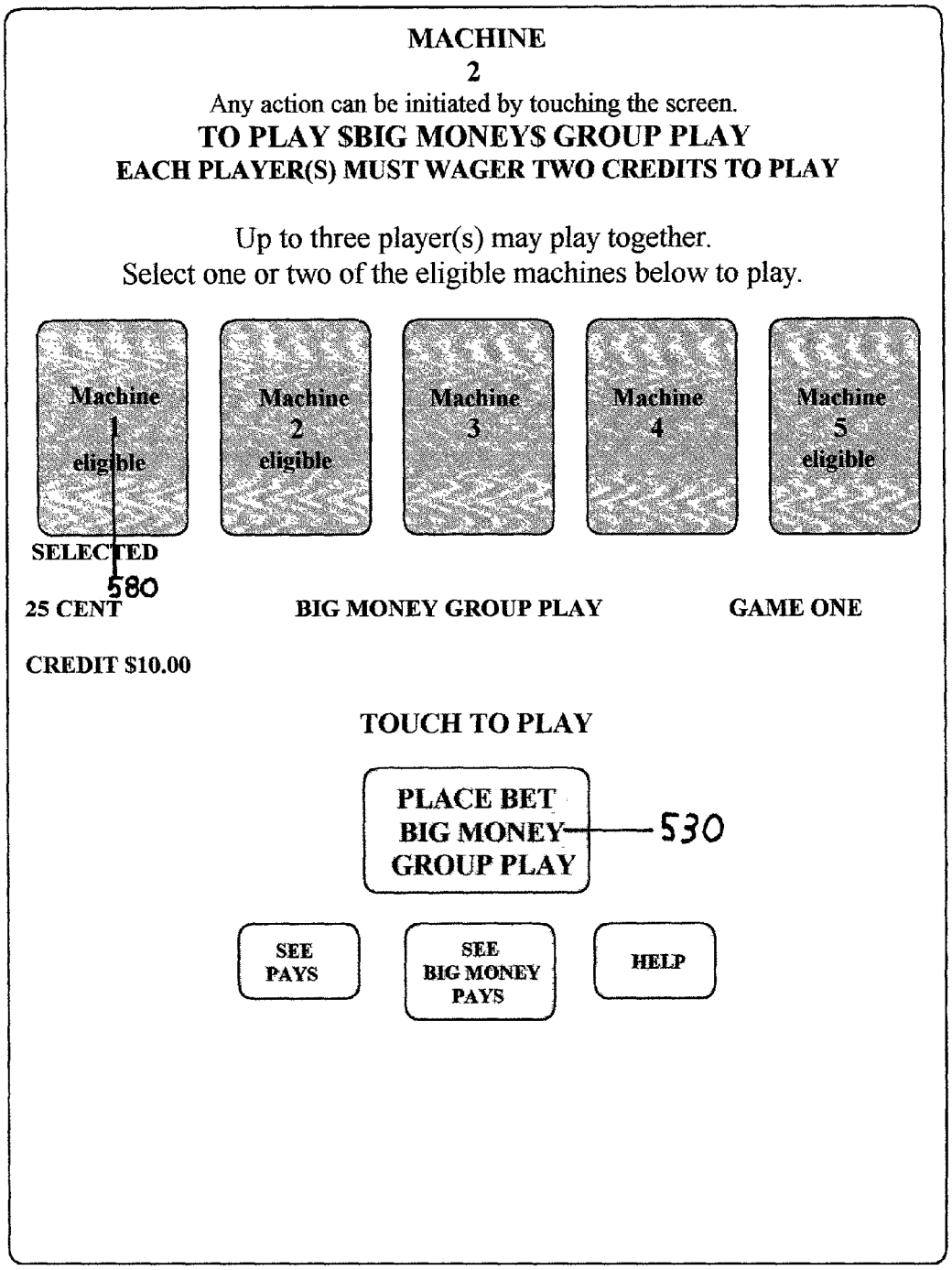

In FIG. 35 player on MACHINE 2 selects to play with another player on eligible MACHINE 1 580 and also selects to place bet on BIG MONEY GROUP PLAY 590.

FIG. 36 shows a representation of a video touch screen displaying information and BIG MONEY GROUP PLAY bet two credits 600 and MACHINES 2&1 are participating in BIG MONEY GROUP PLAY 610.

Figure 37:
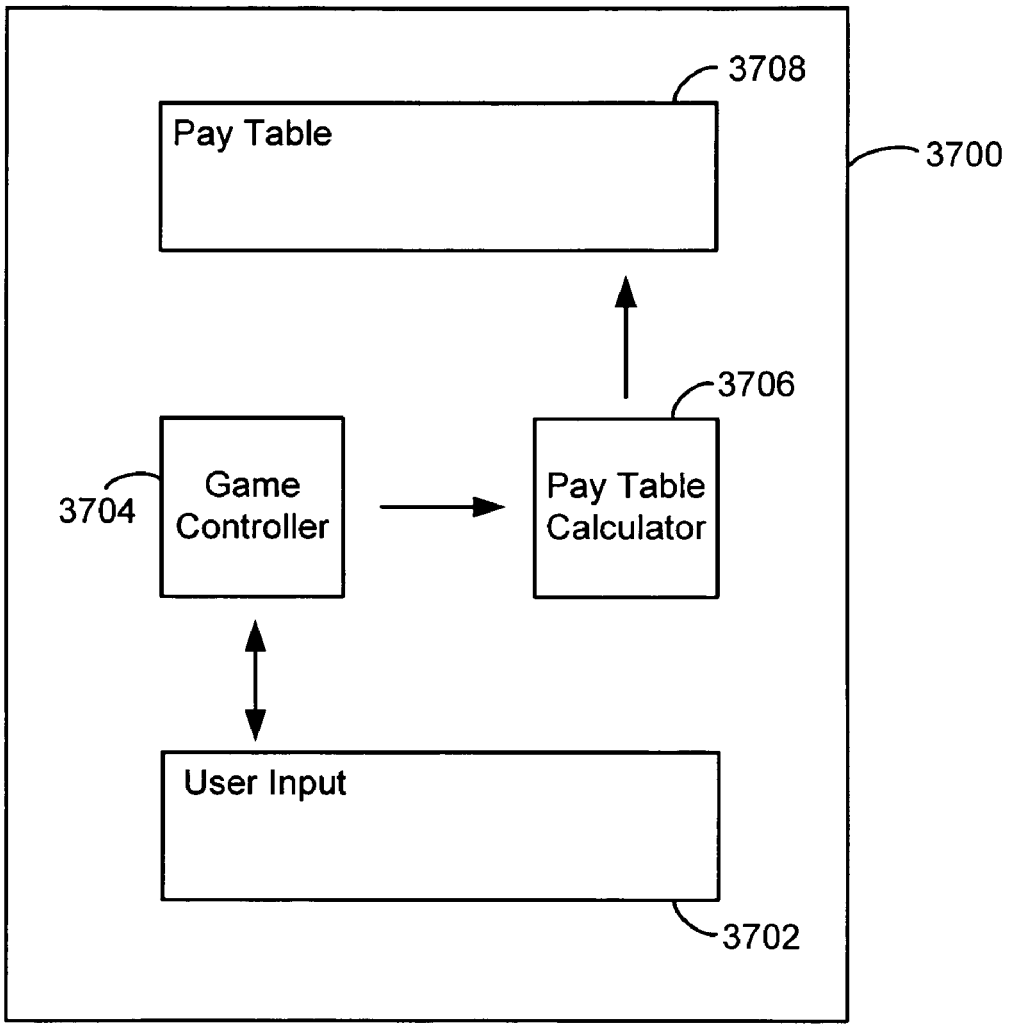
FIG. 37 depicts an electronic gaming apparatus according to one embodiment of the present invention.

FIG. 37 depicts an electronic gaming apparatus 3700 according to one embodiment of the present invention. The electronic gaming device provides a plurality of games accessible to a user. A user-actuatable input 3702 in communication with electronic gaming device 3700 is configured to communicate an input signal from said user. A game controller 3704 is in communication with user-actuatable input 3702 and is configured to initiate play and simultaneously continue play of multiple ones of said plurality of games in response to user activation thereof. A pay table calculator 3706 in communication with game controller 3704 is configured to calculate a composite pay table 3708 based on joint possible results of the multiple ones of said plurality of games initiated by the user activation.

My invention has been disclosed in terms of a preferred embodiment thereof, which provides an improved single and multi format gaming machine and method for combination and/or simultaneous play that is of great novelty and utility. Various changes, modifications, and alterations in the teachings of the present invention may be contemplated by those skilled in the art without departing from the intended spirit and scope thereof. It is intended that the present invention encompass such changes and modifications.

We claim:

1. An electronic gaming apparatus comprising:

an electronic gaming device having a plurality of games accessible to a user, wherein different names in the plurality of names include different odds and pay tables;

a user-actuatable input in communication with said electronic gaming device configured to allow selection of multiple games in the plurality of games and to communicate an input signal from said user;

a game controller in communication with said user-actuatable input, said game controller substantially simultaneously initiating play and substantially simultaneously continuing play of multiple ones of said plurality of games in response to user activation thereof; and a pay table calculator in communication with said game controller to calculate a composite pay table based on the odds and pay tables of said multiple ones of said plurality of games initiated by said user activation.

2. A gaming apparatus according to claim 1, wherein said composite pay table defines a new game.

3. The gaming apparatus of claim 2, wherein a wager is received in order to participate in the new game.

4. A gaming apparatus according to claim 1, wherein said composite pay table defines a bonus table.

5. A gaming apparatus according to claim 1, and further comprising a network interface in communication with said game controller, enabling communication with said game controller from a remote location.

6. A gaming apparatus according to claim 5, wherein said remote location is a separate electronic gaming device.

7. A gaming apparatus according to claim 6, wherein a plurality of separate electronic gaming devices communicate with said game controller.

8. The gaming apparatus of claim 7, wherein the controller is configured to determine an award from the composite pay table.

9. The gaming apparatus of claim 8, wherein the award is based on joint possible outcomes of said multiple ones of said plurality of games from at least two electronic gambling devices in the plurality of separate gaming devices.

10. A gaming apparatus according to claim 7, wherein said composite pay table is communicated to each of said plurality of separate electronic gaming devices.

11. A gaming apparatus according to claim 1, wherein said user-actuatable input means is a touch-screen video monitor.

12. The gaming apparatus of claim 1, wherein the play of the multiple ones of said plurality of games is self-contained in the gaming apparatus.

13. The gaming apparatus of claim 1, further comprising a display configured to display the substantially simultaneous play of the multiple ones of said plurality of games.

14. The gaming apparatus of claim 1, wherein the multiple ones of said plurality of games are independent games.

15. The gaming apparatus of claim 1, wherein the game controller is configured to generate a result for the multiple ones of said plurality of games substantially simultaneously.

16. The gaming apparatus of claim 1, wherein the game controller is configured to generate a result for each of the multiple ones of said plurality of games.

17. A gaming apparatus according to claim 1, wherein the pay table calculator calculates the composite pay table using pay tables and odds of the multiple ones of said plurality of electronic games in addition to wagers received for the multiple ones of said plurality of electronic games.

18. A gaming apparatus according to claim 1, wherein at least one of the plurality of games is a progressive game.

19. The gaming apparatus of claim 16, wherein the game controller is configured to award an award for a game in the multiple ones of said plurality of games if the result for the game is a winning result.

20. The gaming apparatus of claim 16, wherein the game controller is configured to award an award from the composite pay table based on joint results for the multiple ones of said plurality of games.

21. A method of playing an electronic game comprising the steps of:

selecting a first game from a menu comprising a plurality of games presented by an electronic gambling device, wherein different games in the plurality of electronic games include different odds and pay tables;

supplementing said selection of said first game by a further selection of an additional game from said menu of said plurality of games;

generating a composite pay table based on first odds and a first pay table for the first game and second odds and a second pay table based on the additional game; and substantially simultaneously initiating play and concurrently playing said first and said additional games.

22. A method of playing an electronic game according to claim 21, wherein the third pay table comprises at least one of a new game and a bonus game.

23. The method of claim 22, wherein if the third pay table comprises a new game, the method further comprising receiving a wager to participate in the new game.

24. A method of playing an electronic game according to claim 22, and further comprising;

establishing communications between a plurality of electronic gambling devices; and communicating said third pay table to said plurality of electronic gambling devices.

25. The gaming apparatus of claim 24, wherein the controller is configured to determine an award from the composite pay table.

26. The gaming apparatus of claim 25, wherein the award is based on joint possible outcomes of said multiple ones of said plurality of games from at least two electronic gambling devices in the plurality of separate gambling devices.

27. A method according to claim 21, wherein at least on of the first game and additional game comprise a progressive game.

28. The method of claim 21, wherein playing the first and said additional games is self-contained in the electronic gambling device.

29. The method of claim 21, further comprising displaying the concurrent play of the first game and said additional games.

30. The method of claim 21, wherein the first and said additional games are independent games.

31. The method of claim 21, further comprising substantially simultaneously generating a result for the first game and said additional games.

32. The method of claim 21, further comprising determining a first result for the first game and an additional result for the additional game.

33. The method of claim 32, further comprising:

awarding an award from the first pay table if the first result is a winning result for the first pay table; and awarding an award from the second pay table if the second result is a winning result for the second pay table.

34. The method of claim 32, further comprising awarding an award for the third pay table if a combination of the first result and second result is a winning result in the third pay table.

35. A method for providing a plurality of electronic games on an electronic gaming device, the method comprising:

providing a menu including the plurality of electronic games, each electronic game in the plurality of electronic games being independent of one another, wherein different games in the plurality of electronic games include different odds and pay tables;

receiving a selection for two or more of the plurality of electronic games;

determining a composite pay table for the selected two or more games based on the two or more games selected, a wager received for each of the selected two or more games, and the odds and pay tables of the two or more games selected;

substantially simultaneously initiating play of the selected two or more electronic games; and playing the selected two or more electronic games substantially simultaneously.

36. A method according to claim 35, further comprising receiving a wager for each of the selected two or more games.

37. The method of claim 35, wherein the play of the two or more electronic games is self-contained in the electronic gaming device.

38. The method of claim 35, further comprising displaying the concurrent play of the two or more electronic games.

39. The method of claim 35, wherein the two or more electronic games are independent games.

40. The method of claim 35, further comprising substantially simultaneously generating a result for the two or more electronic games.

41. The method of claim 40, further comprising awarding an award from the third pay table if the result is a winning result.

42. The method of claim 35, further comprising determining a result for each of the two or more games.

43. The method of claim 42, further comprising:

awarding an award for a game in the two or more games if the result for the game is a winning result.

44. The method of claim 42, further comprising awarding an award for the composite pay table if a combination of the result for each of the two or more games is a winning result in the composite pay table.

45. A gaming device comprising:

a display of a plurality of games;

a game selection input configured to receive a selection of a first and second game from the plurality of games, wherein different games in the plurality of games include different odds and pay tables;

a pay table generator configured to generate a third pay table based on first odds and a first pay table for the first game and second odds and a second pay table for the second game; and a game controller configured to substantially simultaneous start game play of the selected first and second game in response to a single user input.

46. The gaming device of claim 45, wherein the game controller is configured to generate a result for the first and second game, wherein the display is configured to display the result.

47. The gaming device of claim 46, wherein the result comprises a first result for the first game and a second result for the second game, wherein the first and the second result are determined substantially simultaneously.

48. The gaming device of claim 45, further comprising a wager input configured to receive a wager amount for the first and second game.

49. The gaming device of claim 48, wherein the result corresponds to an award based on the wager amount.

50. The gaming device of claim 45, wherein the first and second games are independent games.

51. The gaming device of claim 45, wherein a result for the first and second game is awarded from the generated third pay table.

52. The gaming device of claim 45, wherein the display is configured to display the game play of the first and the second game substantially simultaneously.

53. The gaming device of claim 45, wherein at least one of the first and the second games comprises a progressive game.

54. The gaming device of claim 45, further comprising a selection input configured to receive any selections by a player that are required for the first and second game, wherein the selections are received before game play of the first and second games is initiated.

55. The gaming device of claim 45, wherein the game controller is configured to determine a first result for the first game and a second result for the second game.

56. The gaming device of claim 55, wherein the game controller is configured to:

award an award from the first pay table if the first result is a winning result for the first pay table; and award an award from the second pay table if the second result is a winning result for the second pay table.

57. The gaming device of claim 55, wherein the game controller is configured to award an award for the third pay table if a combination of the first result and second result is a winning result in the third pay table.

58. A method for providing game play using a gaming device, the method comprising:

displaying a menu of a plurality of games on the gaming device, wherein different games in the plurality of games include different odds and pay tables;

receiving a selection for a first game and a second game in the plurality of games;

receiving a wager for the first game before initiation of play for the first and the second game;

receiving a wager for the second game before initiation of play for the first and the second game;

determining a third pay table based on first odds and a first pay table for the first game and second odds and a second pay table for the second game;

receiving a single user input to initiate game play;

substantially simultaneously initiating play and continuing game play for the first and the second games; and displaying a result for the first and the second games.

59. The method of claim 58, wherein the first and second games are initiated and played in an independent gaming device.

60. The method of claim 58, further comprising determining a result for the first and second games, wherein the result for the first and the second game are controlled and determined by an independent gaming device.

61. The method of claim 58, wherein the first and second games are independent games.

62. The method of claim 58, further comprising displaying the game play of the first and the second game substantially simultaneously.

63. The method of claim 58, wherein at least one of the first and the second games comprises a progressive game.

64. The method of claim 58, further comprising:

determining a first result based on the game play of the first game; and determining a second result based on the game play of the second game, wherein determining the first and the second results are done substantially simultaneously.

65. The method of claim 58, further comprising receiving any selections by a player that are required for the first and second game, wherein the selections are received before game play of the first and second games is initiated.

66. The method of claim 58, wherein the result comprises a first result for the first game and a second result for the second game.

67. The method of claim 66, further comprising:

awarding an award from the first pay table if the first result is a winning result for the first pay table; and awarding an award from the second pay table if the second result is a winning result for the second pay table.

68. The method of claim 66, further comprising awarding an award for the third pay table if a combination of the first result and second result is a winning result in the third pay table.

* * * * *

UNITED STATES PATENT AND TRADEMARK OFFICE

CERTIFICATE OF CORRECTION

PATENT NO. : 7,008,319 B2
APPLICATION NO. : 09/770998
DATED : March 7, 2006
INVENTOR(S) : Montgomery It is certified that error appears in the above-identified patent and that said Letters Patent is hereby corrected as shown below:

Column 15, Line 65, delete “names” and add --games--
Column 15, Line 66, delete “names” and add --games--

Signed and Sealed this

Nineteenth Day of May, 2009

JOHN DOLL
*Acting Director of the United States Patent and Trademark Office*